US010093438B2

(12) United States Patent
Pettersson

(10) Patent No.: US 10,093,438 B2
(45) Date of Patent: Oct. 9, 2018

(54) CONVERTING MACHINE

(71) Applicant: Packsize LLC, Salt Lake City, UT (US)

(72) Inventor: Niklas Pettersson, Västerås (SE)

(73) Assignee: Packsize LLC, Salt Lake City, UT (US)

( * ) Notice: Subject to any disclaimer, the term of this patent is extended or adjusted under 35 U.S.C. 154(b) by 449 days.

(21) Appl. No.: 14/970,224

(22) Filed: Dec. 15, 2015

(65) Prior Publication Data

US 2016/0185475 A1 Jun. 30, 2016

Related U.S. Application Data

(60) Provisional application No. 62/097,455, filed on Dec. 29, 2014.

(51) Int. Cl.

| | |
|---|---|
| ***B65B 5/02*** | (2006.01) |
| ***B65B 43/08*** | (2006.01) |
| ***B65B 11/00*** | (2006.01) |
| ***B65B 59/02*** | (2006.01) |
| ***B31B 50/18*** | (2017.01) |

(Continued)

(52) U.S. Cl.

CPC ..... *B65B 5/024* (2013.01); *B65B 11/004* (2013.01); *B65B 43/08* (2013.01); *B65B 43/10* (2013.01); *B65B 43/24* (2013.01); *B65B 57/10* (2013.01); *B65B 59/02* (2013.01); *B65B 67/10* (2013.01); *B31B 50/18* (2017.08); *B65B 2210/04* (2013.01)

(58) Field of Classification Search

CPC ..... B65B 5/024; B65B 11/004; B65B 43/08; B65B 43/10; B65B 43/24; B65B 57/10; B65B 59/00; B65B 59/02; B65B 67/10; B65B 2210/04; B31B 50/006; B31B 50/18; B31B 50/20

USPC ..... 53/504

See application file for complete search history.

(56) References Cited

U.S. PATENT DOCUMENTS 2,353,419 A * 7/1944 Smithson ..... B65B 59/02 493/354

4,449,349 A * 5/1984 Roth ..... B65B 59/02 493/25

(Continued)

FOREIGN PATENT DOCUMENTS

| | | |
|---|---|---|
| WO | 2011007237 | 1/2011 |
| WO | 2011135433 | 11/2011 |
| WO | 2013071073 | 5/2013 |

OTHER PUBLICATIONS

International Search Report and Written Opinion for PCT/US2015/67375 dated Mar. 11, 2016.

*Primary Examiner* — Stephen F Gerrity

(74) *Attorney, Agent, or Firm* — Workman Nydegger

(57) ABSTRACT

Systems, methods, and apparatus for converting a sheet material into packaging templates can include a converting machine that performs conversion functions, such as cutting, creasing, and scoring, on the sheet material. Items to be packed into boxes formed of the packaging templates can be used as the pattern for determining the location of performance of the conversion functions on the sheet material. Accordingly, no intermediate measuring of the items may be required prior to performance of the conversion functions. Instead, longheads can be positioned adjacent to opposing sides of the items and cross heads can be advanced inward to the positioned longheads.

40 Claims, 19 Drawing Sheets

(51) Int. Cl.

| | |
|---|---|
| ***B31B 50/00*** | (2017.01) |
| ***B65B 57/10*** | (2006.01) |
| ***B65B 43/10*** | (2006.01) |
| ***B65B 43/24*** | (2006.01) |
| ***B65B 67/10*** | (2006.01) |

(56) References Cited

U.S. PATENT DOCUMENTS

| | | | | |
|---|---|---|---|---|
| 4,887,412 | A * | 12/1989 | Takamura | B65B 57/04 53/136.3 |
| 5,671,593 | A * | 9/1997 | Ginestra et al. | B65B 59/00 53/168 |
| 5,964,686 | A * | 10/1999 | Bidlack et al. | B26D 1/185 493/160 |
| 7,647,752 | B2 * | 1/2010 | Magnell | B65B 59/00 493/52 |
| 2004/0060264 | A1 * | 4/2004 | Miller | B65B 11/18 53/461 |
| 2004/0082453 | A1 | 4/2004 | Pettersson | |
| 2013/0000252 | A1 | 1/2013 | Pettersson et al. | |
| 2013/0045847 | A1 * | 2/2013 | Capoia | B26D 7/2635 493/59 |
| 2015/0224731 | A1 * | 8/2015 | Ponti | B65B 11/004 493/59 |
| 2015/0360433 | A1 * | 12/2015 | Feijen et al. | B65B 5/024 53/456 |
| 2015/0360801 | A1 * | 12/2015 | Sytema | B65B 43/10 53/74 |

* cited by examiner

CONVERTING MACHINE

CROSS-REFERENCE TO RELATED APPLICATIONS

This application claims priority to and the benefit of U.S. Provisional Patent Application No. 62/097,455, filed Dec. 29, 2014, and entitled Converting Machine, the entirety of which is incorporated herein by reference.

BACKGROUND

1. Technical Field

This disclosure relates to systems, methods, and apparatus for converting sheet materials. More specifically, this disclosure relates to converting machines for converting paperboard, corrugated board, cardboard, and similar sheet materials into templates for forming boxes and other packaging.

2. Relevant Technology

Shipping and packaging industries frequently use paperboard and other sheet material processing equipment that converts sheet materials into boxes (or box templates). One advantage of such equipment is that a shipper may prepare boxes of required sizes as needed in lieu of keeping a stock of standard, pre-made boxes of various sizes. Consequently, the shipper can eliminate the need to forecast its requirements for particular box sizes as well as to store pre-made boxes of standard sizes. Instead, the shipper may store one or more bales of fanfold material, which can be used to generate a variety of box sizes based on the specific box size requirements at the time of each shipment. This allows the shipper to reduce storage space normally required for periodically used shipping supplies as well as reduce the waste and costs associated with the inherently inaccurate process of forecasting box size requirements, as the items shipped and their respective dimensions vary from time to time.

In addition to reducing the inefficiencies associated with storing pre-made boxes of numerous sizes, creating custom sized boxes also reduces packaging and shipping costs. In the fulfillment industry it is estimated that shipped items are typically packaged in boxes that are about 65% larger than the shipped items. Boxes that are too large for a particular item are more expensive than a box that is custom sized for the item due to the cost of the excess material used to make the larger box. When an item is packaged in an oversized box, filling material (e.g., Styrofoam, foam peanuts, paper, air pillows, etc.) is often placed in the box to prevent the item from moving inside the box and to prevent the box from caving in when pressure is applied (e.g., when boxes are taped closed or stacked). These filling materials further increase the cost associated with packing an item in an oversized box.

Customized sized boxes also reduce the shipping costs associated with shipping items compared to shipping the items in oversized boxes. A shipping vehicle filled with boxes that are 65% larger than the packaged items is much less cost efficient to operate than a shipping vehicle filled with boxes that are custom sized to fit the packaged items. In other words, a shipping vehicle filled with custom sized packages can carry a significantly larger number of packages, which can reduce the number of shipping vehicles required to ship the same number of items. Accordingly, in addition or as an alternative to calculating shipping prices based on the weight of a package, shipping prices are often affected by the size of the shipped package. Thus, reducing the size of an item's package can reduce the price of shipping the item. Even when shipping prices are not calculated based on the size of the packages (e.g., only on the weight of the packages), using custom sized packages can reduce the shipping costs because the smaller, custom sized packages will weigh less than oversized packages due to using less packaging and filling material.

Although sheet material processing machines and related equipment can potentially alleviate the inconveniences associated with stocking standard sized shipping supplies and reduce the amount of space required for storing such shipping supplies, previously available machines and associated equipment have various drawbacks. For instance, previously available machines have had a significant footprint and have occupied a lot of floor space. The floor space occupied by these large machines and equipment could be better used, for example, for storage of goods to be shipped. In addition to the large footprint, the size of the previously available machines and related equipment makes manufacturing, transportation, installation, maintenance, repair, and replacement thereof time consuming and expensive.

In addition to their size, previous converting machines have been quite complex and have required access to sources of high power and compressed air. More specifically, previous converting machines have included both electrically powered components as well as pneumatic components. Including both electric and pneumatic components increases the complexity of the machines and requires the machines to have access to both electrical power and compressed air, as well as increases the size of the machines. Likewise, previous converting machines can be prohibitively expensive to purchase, operate, and maintain. The size, complexity, and cost can be deterrents to users who do not possess the space, technical knowhow, and resources required to implement previous converting machines.

Furthermore, previous converting machines often require an intermediate measuring step prior to forming the packaging template. For instance, a user may measure the three-dimensional size of an object in order to then adjust the settings of the converting machine to produce a packaging template that forms a custom-fit box for the object. This intermediate measuring step can be time-consuming and can introduce additional human error as the measurement parameters are transferred to the converting machine.

Accordingly, it would be advantageous to have a relatively small and simple converting machine to conserve floor space, reduce electrical power consumption, eliminate the need for access to compressed air, and reduce maintenance costs and downtime associated with repair and/or replacement of the machine. In addition, it would be advantageous to have an inexpensive alternative to existing converting machine such that users can afford to purchase, operate, and maintain the converting machine in a manner that is profitable. Furthermore it would be valuable to eliminate the time-consuming and error-prone separate or independent measuring step(s).

BRIEF SUMMARY

Embodiments of the present disclosure solve one or more of the foregoing or other problems in the art with systems, methods, and apparatus for creating packaging templates for assembly into one or more boxes or other packaging material. In particular, the present disclosure relates to systems, methods, and apparatus for processing sheet material (such as corrugated paperboard or cardboard) and converting the same into custom packaging templates. For example, certain embodiments include a converting machine. An illustrative converting machine can include a frame, a conversion assembly, and/or means for advancing sheet material through the conversion assembly. The conversion assembly can be adapted for performing one or more conversion functions on or to the sheet material (e.g., to thereby convert the sheet material into the packaging template).

Some embodiments can include a method of forming a packaging template (that is custom-made for packaging one or more items). For instance, in connection with a packaging system that includes a converting machine, an illustrative method can include placing the one or more items in a receiving area of the converting machine, adjusting one or more components of the converting machine according to at least one outer dimension of the one or more items, and converting sheet material into a packaging template configured for assembly into a box or packaging adapted for receiving the one or more items.

Additional features and advantages of exemplary embodiments of the present disclosure will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

BRIEF DESCRIPTION OF THE DRAWINGS

In order to describe the manner in which the above-recited and other advantages and features of the disclosure can be obtained, a more particular description of the disclosure briefly described above will be rendered by reference to specific embodiments and/or implementations thereof which are illustrated in the appended drawings. For better understanding, the like elements have been designated by like reference numbers throughout the various accompanying figures. Understanding that these drawings depict only typical embodiments and/or implementations of the disclosure and are not therefore to be considered to be limiting of its scope, the embodiments and/or implementations will be described and explained with additional specificity and detail through the use of the accompanying drawings in which.

DETAILED DESCRIPTION

Figure 1:
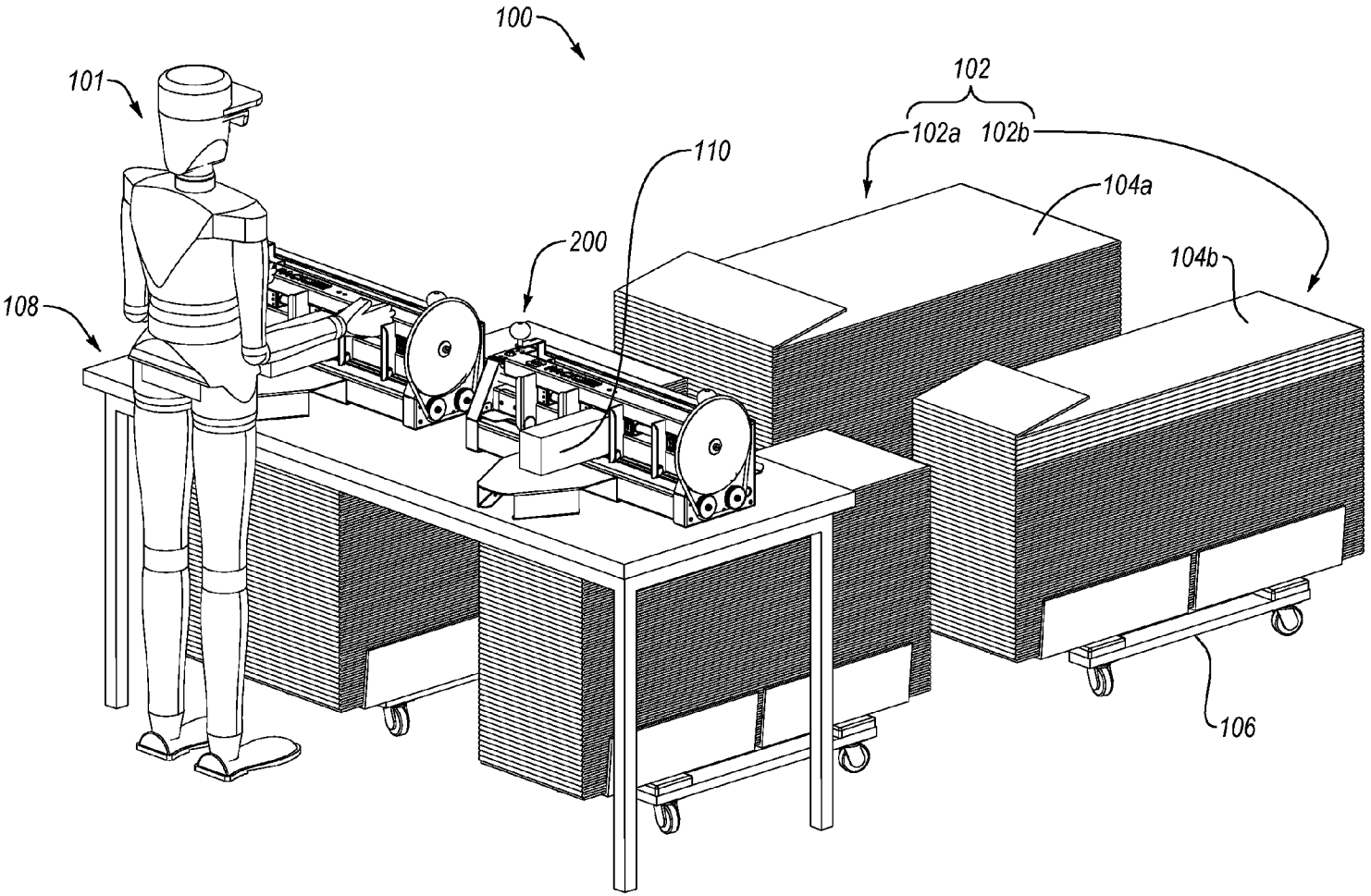
FIG. 1 illustrates a perspective view of a packaging system in accordance with an embodiment of the present disclosure.

Before describing the present disclosure in detail, it is to be understood that this disclosure is not limited to parameters of the particularly exemplified systems, methods, apparatus, products, processes, compositions, and/or kits, which may, of course, vary. It is also to be understood that the terminology used herein is only for the purpose of describing particular embodiments of the present disclosure, and is not intended to be limiting in any manner. Thus, while the present disclosure will be described in detail with reference to specific configurations, the descriptions are illustrative and are not to be construed as limiting the scope of the present invention. Various modifications can be made to the illustrated configurations without departing from the spirit and scope of the invention as defined by the claims.

The headings used herein are for organizational purposes only and are not meant to be used to limit the scope of the description or the claims. To facilitate understanding, like reference numerals have been used, where possible, to designate like elements common to the figures.

All publications, patents, and patent applications cited herein, whether supra or infra, are hereby incorporated by reference in their entirety to the same extent as if each individual publication, patent, or patent application was specifically and individually indicated to be incorporated by reference.

Unless defined otherwise, all technical and scientific terms used herein have the same meaning as commonly understood by one of ordinary skill in the art to which the present disclosure pertains. While a number of methods and materials similar or equivalent to those described herein can be used in the practice of the present disclosure, only preferred materials and methods are described herein.

Various aspects of the present disclosure, including devices, systems, methods, etc., may be illustrated with reference to one or more exemplary embodiments. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and is intended to provide illustrative examples without limiting the scope of the invention, which is indicated by the appended claims rather than by the following description.

As used throughout this application the words "can" and "may" are used in a permissive sense (i.e., meaning having the potential to), rather than the mandatory sense (i.e., meaning must). Additionally, the terms "including," "having," "involving," "containing," "characterized by," and variants thereof (e.g., "includes," "has," and "involves," "contains," etc.) as used herein, including the claims, shall be inclusive and/or open ended, shall have the same meaning as the word "comprising" and variants thereof (e.g., "comprise" and "comprises"), and does not exclude additional, un-recited elements or method steps, illustratively.

It will also be noted that, as used herein, the singular forms "a," "an" and "the" can also include plural referents unless the content clearly dictates otherwise. Thus, for example, reference to a "packaging material" can include one, two, or more packaging materials. Likewise, reference to an "item" includes one, two, or more items. Similarly, reference to a plurality of referents should be interpreted as comprising a single referent and/or a plurality of referents unless the content and/or context clearly dictate otherwise. Thus, reference to "items" does not necessarily require a plurality of such items. Instead, it will be appreciated that independent of conjugation; one or more items are contemplated herein.

As used herein, directional and/or arbitrary terms, such as "top," "bottom," "left," "right," "up," "down," "upper," "lower," "inner," "outer," "proximal," "distal" and the like can be used herein solely to indicate relative directions and/or orientations and may not otherwise be intended to limit the scope of the disclosure, invention, and/or claims to any particular orientation during use or at any other time.

Where possible, like numbering of components and/or elements have been used in various figures. Furthermore, multiple instances of an element and or sub-elements of a parent element may each include separate letters appended to the element number. For example two instances of a particular element "706" may be labeled as "706*a*" and "706*b*". In that case, the element label may be used without an appended letter (e.g., "706") to generally refer to instances of the element or any one of the elements. Element labels including an appended letter (e.g., "706*a*") can be used to refer to a specific instance of the element or to distinguish or draw attention to multiple uses of the element.

Furthermore, an element label with an appended letter can be used to designate an alternative design, structure, function, implementation, and/or embodiment of an element or feature without an appended letter. For instance, an element "410" can have alternative designs indicated by element labels "410*a*" and "410*e*." Likewise, an element label with an appended letter can be used to indicate a sub-element of a parent element. However, element labels including an appended letter are not meant to be limited to the specific and/or particular embodiment(s) in which they are illustrated. In other words, reference to a specific feature in relation to one embodiment should not be construed as being limited to applications only within said embodiment.

Various aspects of the present devices and systems may be illustrated by describing components that are coupled, attached, and/or joined together. As used herein, the terms "coupled", "attached", and/or "joined" are used to indicate either a direct connection between two components or, where appropriate, an indirect connection to one another through intervening or intermediate components. In contrast, when a component is referred to as being "directly coupled", "directly attached", and/or "directly joined" to another component, there are no intervening elements present. Furthermore, as used herein, the terms "connection," "connected," and the like do not necessarily imply direct contact between the two or more elements.

It will also be appreciated that where a range of values (e.g., less than, greater than, at least, or up to a certain value, or between two recited values) is disclosed or recited, any specific value or range of values falling within the disclosed range of values is likewise disclosed and contemplated herein. Thus, disclosure of an illustrative measurement or distance less than or equal to about 10 millimeters (mm) or between 0 and 10 mm includes, illustratively, a specific disclosure of: (i) a measurement of 9 mm, 5 mm, 1 mm, or any other value between 0 and 10 mm, including 10 mm; and/or (ii) a measurement between 9 mm and 1 mm, between 8 mm and 2 mm, between 6 mm and 4 mm, and/or any other range of values between 0 and 10 mm.

It will also be appreciated that where dimensional measurements or terms are used herein, such as a "height," "width," "length," etc. (e.g., in relation to the packaging and/or the positioning of the components of the converting machine and/or the process herein described), the dimensional measurements and/or distances may include deviations from the actual dimension (e.g., of the item or items). For instance, depending on packaging design and material thicknesses used in some embodiments, additional space (buffer) may need to be added (e.g., in order to accommodate a various number of layers of folded packaging material, or for other reasons, such as room for protective material, etc. Accordingly, such buffers are also contemplated herein.

It is also noted that systems, methods, apparatus, devices, products, processes, compositions, and/or kits, etc., according to certain embodiments of the present invention may include, incorporate, or otherwise comprise properties, features, components, members, and/or elements described in other embodiments disclosed and/or described herein. Thus, reference to a specific feature in relation to one embodiment should not be construed as being limited to applications only within said embodiment.

As used herein, the term "bale" shall refer to a stock of sheet material that is generally rigid or semi-rigid in at least one direction, and may be used to make a packaging template. For example, the bale may be formed of continuous sheet of generally rigid material or a sheet of material of any specific length, such as corrugated cardboard and paperboard sheet materials. Additionally, the bale may have stock material that is substantially flat, folded, or wound onto a bobbin. Furthermore, the bale may comprise a "fan-folded" stack of sheet material that can be dispensed from a (terminal) end thereof.

As used herein, the term "packaging template" shall refer to a substantially flat stock of sheet material that can be folded into a box-like shape. A packaging template may have notches, cutouts, divides, perforations, and/or creases that allow the packaging template to be bent and/or folded into a box. Additionally, a packaging template may be made of any suitable material, generally known to those skilled in the art. For example, cardboard or corrugated paperboard may be used as the template sheet material. A suitable material also may have any thickness and weight that would permit it to be bent and/or folded into a box-like shape.

As used herein, "cutting," "severing," and similar terms can include separating two joined portions of (sheet) material through one or more conversion functions, such as cutting, slicing, and so forth, any of which may be expressed interchangeably without necessarily departing from the scope of this disclosure. In at least one embodiment, severing includes cutting entirely through the thickness of at least a portion of the material.

The terms "notch," "cutout," and "cut" are used interchangeably herein and shall refer to a shape created by removing material from the template or by separating portions of the template, such that a cut through the template is created.

As used herein, "creasing" and similar terms can include processing a portion of (sheet) material so as to compromise the (semi-rigid) integrity thereof such that the shape of the material can be altered more easily than prior to processing. For instance, creasing can include compressing, compacting, folding, bending, perforated, partially cutting (e.g., without cutting entirely through the thickness of) at least a portion of the material. In at least one embodiment, creasing differs from severing in that while severing includes at least partially separating two joined portions of the material (e.g., by cutting entirely through the thickness thereof), creasing retains substantial joinder of the two joined portions.

As used herein, the term "crease" shall refer to a line along which the template may be folded. For example, a crease may be an indentation in the template material, which may aid in folding portions of the template separated by the crease, with respect to one another. A suitable indentation may be created by applying sufficient pressure to reduce the thickness of the material in the desired location and/or by removing some of the material along the desired location, such as by scoring.

The embodiments described herein generally relate to systems, methods, and apparatus for creating packaging templates for assembly into one or more boxes or other packaging material. In particular, the present disclosure relates to systems, methods, and apparatus for processing sheet material (such as corrugated paperboard or cardboard) and converting the same into custom packaging templates. For example, certain embodiments include a converting machine. An illustrative converting machine can include a frame, a conversion assembly, and/or means for advancing sheet material through the conversion assembly. The conversion assembly can be adapted for performing one or more conversion functions on or to the sheet material (e.g., to thereby convert the sheet material into the packaging template).

Some embodiments can include a method of forming a packaging template (that is custom-made for packaging one or more items). For instance, in connection with a packaging system that includes a converting machine, an illustrative method can include placing the one or more items in a receiving area of the converting machine, adjusting one or more components of the converting machine according to at least one outer dimension of the one or more items, and converting sheet material into a packaging template configured for assembly into a box or packaging adapted for receiving the one or more items.

Illustrative methods of the present disclosure can also include advancing the sheet material to a first position, performing one or more longitudinal conversion function on at least a portion of the sheet material (e.g., while advancing the sheet material), and performing one or more transverse conversion function on at least a portion of the sheet material at the first position. In at least one embodiment, the first position (or length of advancing thereto) can correspond to an outer dimension (e.g., height) of one or more items to be packaged. In some embodiments, the method can include advancing the sheet material to a second position and performing one or more transverse conversion function on at least a portion of the sheet material at the second position. In at least one embodiment, the second position (or length of advancing thereto) can likewise correspond to an outer dimension (e.g., length) of one or more items to be packaged. These basic steps can be repeated as necessary to produce a custom packaging template configured to be assembled into a box that is sized according to the dimension(s) of the one or more items.

In some embodiments, the one or more items themselves can provide the parameters or measurements for advancing the sheet material to the first, second, and/or subsequent positions. In other words, certain embodiments do not require separate, intermediate, and/or additional measuring of the one or more items prior to processing. For instance, the converting machine (or conversion assembly thereof) can include one or more longitudinal conversion elements (e.g., longheads) configured to perform the one or more longitudinal conversion functions (e.g., creasing, cutting). First and second (inner) longheads can be positioned adjacent to opposing outer sides or walls of the one or more items such that the distance or separation between the longheads corresponds substantially to the width of the one or more items (e.g., with the addition of an optional buffer amount). As the sheet material is advanced through the conversion assembly, the positioned longheads can then create creases (or perform another longitudinal conversion function) on or in the sheet material at positions corresponding to the outer sides of the one or more items. Accordingly, the packaging template produced thereby can be folded along the creases (or other conversion feature) to produce a three-dimensional, custom box configured to receive the one or more items.

Similarly, after advancing the sheet material a first distance (e.g., corresponding to the height of the one or more items), transverse conversion elements (e.g., crossheads) can be deployed to create cuts (or other transverse conversion features, such as creases) in or on the sheet material at the first position. By deploying the crossheads from an outer position to an inner position (e.g., corresponding to the positioned longheads, the cuts can produce flaps in the packaging template instead of separating the packaging template from the feed supply of sheet material. Accordingly, the packaging template produced thereby can be folded at the position of the cut flaps to produce structural components of a custom box, regular slotted container (RSC), or receptacle (e.g., packaging material) configured to receive the one or more items. For instance, the folded, cut flaps can produce one or more of the side walls, top, bottom, etc. of the box, or can comprise reinforcing, securing, or locking flaps thereof. In embodiments where the sheet material comprises a bale of fan-folded corrugated paperboard, for example, a final separating cut can also be performed to release the packaging template from the feed supply.

Those skilled in the art will appreciate that the packaging template can be assembled into a box in a variety of ways, methods, and/or mechanisms. For instance, the creased and/or cut transverse flaps can be folded to produce the side walls of a box having a hingedly-opening and/or flap-tucking upper top and/or lid. Thus, in a wrap-around assembly mechanism, a first portion of the template can be folded and/or assembled into a receptacle having a (seamlessly connected) front wall, bottom wall, and back (rear) wall. Flaps extending (seamlessly) transversely outward from one or more (e.g., each) of the aforementioned walls can be folded inward (e.g., to a 90 degree angle relative to the wall from which it extends) to (collectively) produce opposing (left and right) side walls comprising folded and/or stacked flaps. A second portion of the template extending (seamlessly) from the upper end of the front or rear wall can comprise a lid or top wall. The top wall can also have one or more (e.g., opposing) flaps extending transversely outward therefrom. The lid can be hindegly-folded to associate with the receptacle and the flap(s) can be tucked adjacent to (e.g., outside, inside, and/or between the opposing side wall flaps of the receptacle. The lid can also have a front flap extending (seamlessly) longitudinally from an opposing end (i.e., from an end opposite the front or rear wall to which the lid is connected and/or from which the lid extends. The front flap can also be tucked and/or folded during assembly.

In an alternative (RSC) embodiment, the packaging template can be folded (longitudinally) into a continuous and/or circular configuration and, optionally, adhered or fastened (e.g., to produce a collapsed RSC). In particular, longitudinal (terminal) ends of the template can be fastened together to produce a tubular template having at least one seam and a plurality a template segment or body sections. The template segment or body sections can (each) have one or more transversely outwardly extending flaps, which can be folded inward (e.g., to a 90 degree angle relative to the segment from which it extends) to (collectively) produce opposing (top and bottom) portions of the box. Thus, the top and bottom can also (each) comprise a folded and/or stack of flaps, in some embodiments. Additional and/or alternative configurations and/or features of configurations will become apparent by or may be learned by the practice of various exemplary embodiments of the present disclosure.

As used herein, "corresponding position" and similar terms can include positions adjacent to, similar to, and/or in proximity to a reference point (e.g., side wall). One will appreciate, therefore, that a "corresponding position" does not necessarily require the same or identical position. Accordingly, a buffer or other space can be disposed between a first and second object without necessarily negating the first object being in a position corresponding to the position of the first object.

In at least one embodiment, the method can be performed by means of a converting machine having a first end, a second end (e.g., opposite the first end), and a longitudinal length extending therebetween. The first end can have a sheet material inlet and the second end can have a packaging template outlet. The converting machine can also have a first side, a second side (e.g., opposite the first side), and a transverse width extending therebetween. The converting machine can also include a (structural) frame or frame assembly configured to support a conversion assembly and/or an advancing mechanism. The advancing mechanism can comprise one or more advancing members disposed about the converting machine and can be adapted for feeding and/or advancing the sheet material through the conversion assembly. For instance, an illustrative advancing mechanism can comprise a plurality of wheels configured to feed the material through the conversion assembly.

The conversion assembly can be disposed between the first and second ends (e.g., along the longitudinal length) and/or between the first and second sides (e.g., along the transverse width). The conversion assembly can be adapted for performing one or more conversion functions on or to the sheet material (e.g., to thereby convert the sheet material into the packaging template). Specifically, the conversion assembly can comprise one or more longitudinal conversion elements (e.g., longheads) for performing one or more longitudinal conversion functions. The longheads can be selectively positionable about at least a portion of the transverse width of the converting machine or conversion assembly thereof. For instance, the longheads can be connected to one or more transverse cross member(s) disposed at least partially between the first and second sides. In some embodiments, the longheads can slide along the cross member(s) to one or more positions suitable for converting the sheet material into the packaging template.

In some embodiments, the conversion assembly can include a symmetrical movement apparatus connected to the longheads. The symmetrical movement apparatus can coordinate symmetrical (e.g., equal and opposite) movement of the longheads about the transverse width. For instance, inward movement of a first longhead (e.g., from a first outer position on the first side of the conversion assembly) can (simultaneously) result in inward movement of a second longhead (e.g., from a second outer position on the second side of the conversion assembly). A similar (and/or separate) symmetrical movement apparatus can coordinate symmetrical movement of the crosshead(s) about the transverse width.

In some embodiments, the conversion assembly can include a second set (e.g., pair) of longheads or other longitudinal conversion elements. For instance, an outer pair of longheads can be adapted for creasing and/or cutting the sheet material at a second transverse position along the transverse width of the conversion assembly. Cutting longheads can trim the sheet material to an appropriate width for a custom packaging template. Alternatively, creasing longheads can produce foldable flaps for reinforcing and/or securing the packaging template in a folded (e.g., box-like) configuration. In other embodiments, the outer or extra longitudinal crease(s) can enable the packaging template to fold all around the item to be packaged, for example, creating a wrap-around packaging. This can be especially useful or productive with longer or "skinny" items, where a wrap-around along the longitudinal feeding axis often is easier to handle.

Furthermore, the conversion assembly can include one or more sets of crossheads configured to perform transverse conversion functions at various longitudinal positions along the length of the sheet material. Some of the crossheads can perform cuts up to (but not beyond) the (inner) longheads in some embodiments. Similar (and/or separate) symmetrical movement apparatus can also coordinate symmetrical movement of the second set of longheads and/or crossheads about the transverse width. In some embodiments, one or more longheads and/or crossheads can be released from attachment to the symmetrical movement apparatus, such that, for example, the crossheads can move independently, and even across the full width of the packaging (e.g., beyond the position of one or more of the (inner) longheads).

I. Systems and Apparatus

Reference will now be made to systems and apparatus, as well as components (e.g., elements, members, and/or features) thereof, illustrated in the Figures of the present disclosure. One will appreciate that the figures illustrate exemplary embodiments and that equivalent and/or additional embodiments also fall within the scope of this disclosure. Accordingly, the figures and figure description are not intended to limit the scope of this disclosure to the described and/or illustrated components.

FIG. 1 illustrates a perspective view of a system 100 that may be used to create packaging templates. System 100 can include at least one feed supply 102 of sheet material 104. For instance, system 100 includes a first feed supply 102*a* of sheet material 104*a* and a second feed supply 102*b* of sheet material 104*b*. As illustrated in FIG. 1, sheet material 104*a* has a wider configuration than sheet material 104*b*. Thus, in at least one embodiment, system 100 can be configured to accommodate and/or utilize a plurality of differently-sized sheet materials 104.

Feed supply 102 can comprise a bale having a fanfold, rolled, or other configuration. Feed supply 102 can also comprise one or more (pre-cut) pieces of sheet material 104. Sheet material 104 can comprise paperboard, corrugated board, or cardboard as known in the art and can have a substantially flat configuration. Importantly, sheet material 104 can be malleable, severable, or otherwise configurable or convertible (into a packaging template) by means of one or more conversion functions performed thereon.

System 100 can also include a feed supply base 106. Base 106 can comprise a mobile cart, trolley, or other device adapted for enhancing the mobility of feed supply 102. Accordingly, system 100 can be adapted for interchangeability of various feed supplies 102.

System 100 can be used to create a packaging template for item 110. Item 110 can include one or more items, such as item(s) to be packaged and/or model item(s) for producing a custom packaging template. As used herein, "item," "goods," and similar terms can be used to denote one or more to-be-packaged items, whether conjugated in singular or plural form. Thus, reference to an "item" should be interpreted as comprising a single item and/or a plurality of items. Similarly, reference to "items" does not necessarily require a plurality of such items. Instead, it will be appreciated that independent of conjugation; one or more items are contemplated herein.

In certain embodiments, item 110 can be used to determine the appropriate size and/or configuration of the packaging template to be produced by the systems, methods, and/or apparatus described herein. For instance, the packaging template may be configured according to one or more (outer) dimensions of item 110. Those skilled in the art will appreciate that the outer dimension(s) of a plurality of items 110 can comprise the collective outer dimensions thereof. For instance, the outer dimensions of the item 110 can comprise the dimensions circumscribing the one or more items 110.

In some embodiments, the outer dimensions of item 110 can provide a pattern for forming the packaging template (e.g., without requiring additional measuring of the dimensions (e.g., length, width, and/or height)). For instance, system 100 can include a converting machine 200 configured to produce packaging templates from sheet material 104. As discussed in further detail below, converting machine 200 can be adjusted and/or configured to produce a custom packaging template based on the actual dimensions of the item 110 by receiving the item 110 in a receiving area. The outer dimensions of the item 110 can then be marked or measured by adjusting and/or positioning certain components of converting machine 200 according to the outer dimensions (e.g., against the outer sides) of item 110.

System 100 can also include a support structure 108. Support structure 108 can comprise a table or frame configured to rest upon a support surface, such as a floor. Converting machine 200 can be placed and/or mounted on support structure 108. One or more users 101 can position themselves (e.g., stand, sit, etc.) adjacent to converting machine 200 and operate the same. As will be discussed in further detail below, operation of converting machine 200 can include manual, electric, pneumatic, automatic, and/or responsive operation functions. In at least one embodiment, converting machine 200 can be entirely manually operated. A further description of certain components of system 100 will now be discussed in more detail.

Figure 2:
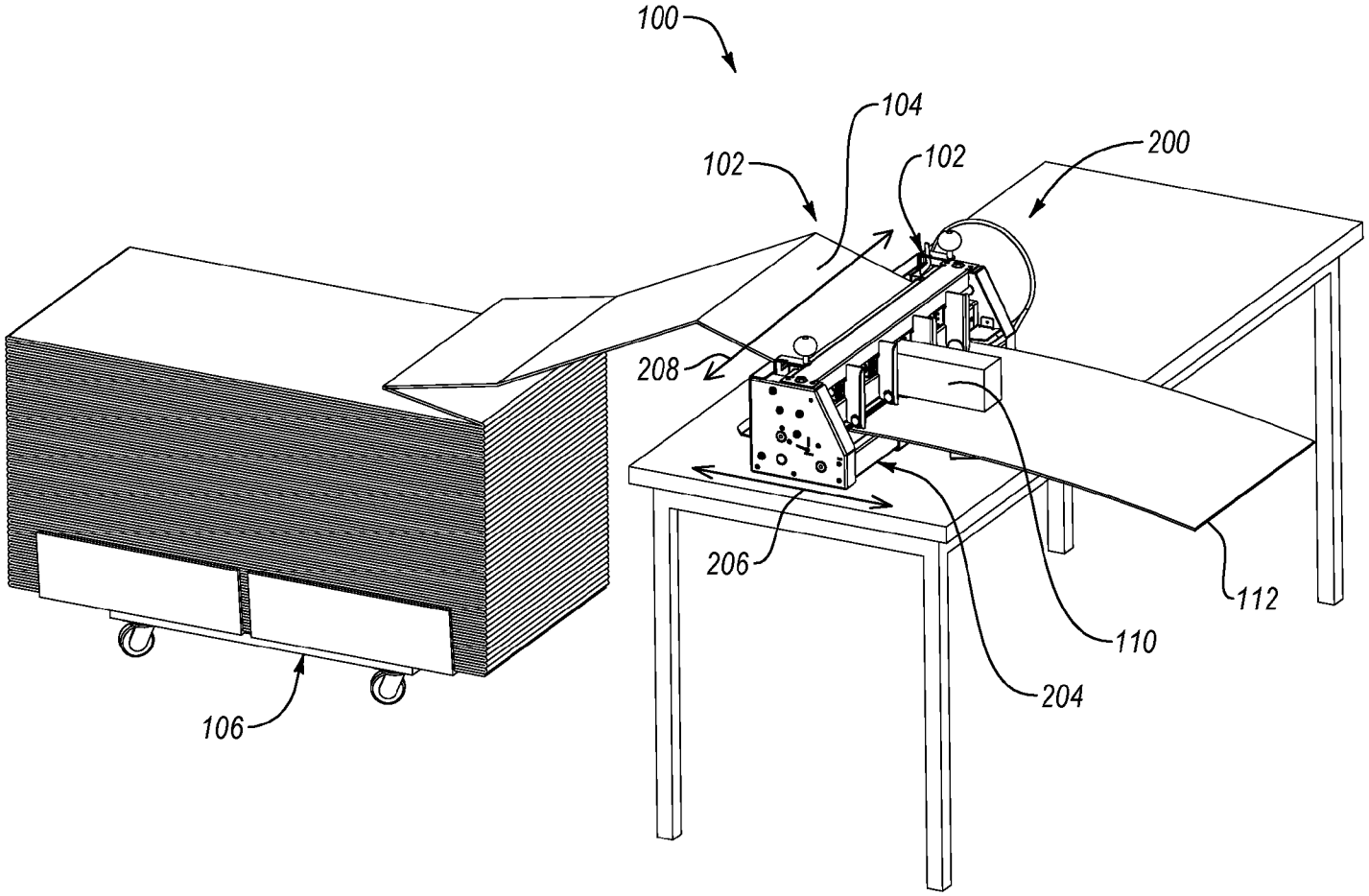
FIG. 2 illustrates a perspective view of some components of the packaging system of FIG. 1.

As illustrated more fully in FIG. 2, converting machine 200 of system 100 can be configured to receive feed supply 102 of sheet material 104 and perform the one or more conversion functions thereon in order to create one or more packaging templates 112. After being produced, packaging template 112 may be formed into a packaging container (not shown), such as a box, configured to receive item 110. The outer dimensions of item 110 can be used as direct measurements or parameters for forming packaging template 112. Thus, item 110 can provide the model for forming packaging template 112 (e.g., with no intermediate measuring required).

The one or more conversion functions can alter the configuration of sheet material 104 in order to convert sheet material 104 into packaging template 112. Such alterations can include severing at least a portion of sheet material 104. In at least one embodiment, severing can include separating the completed packaging template 112 from the feed stock 102 of sheet material 104. Alterations can also include creasing at least a portion of sheet material 104.

Sheet material 104 can be advanced through converting machine 200 in a longitudinal direction. As illustrated in FIG. 2, for instance, sheet material 104 can enter converting machine 200 at a first end 202 (e.g., rear or back end), advance through the converting machine 200 in the longitudinal direction 206, and exit converting machine 200 at a second end 204 (e.g., front end). As will be discussed in further detail below, various conversion functions can be performed by converting machine 200 on sheet material 104 in the longitudinal direction 206 and/or transverse direction 208.

Figure 3:
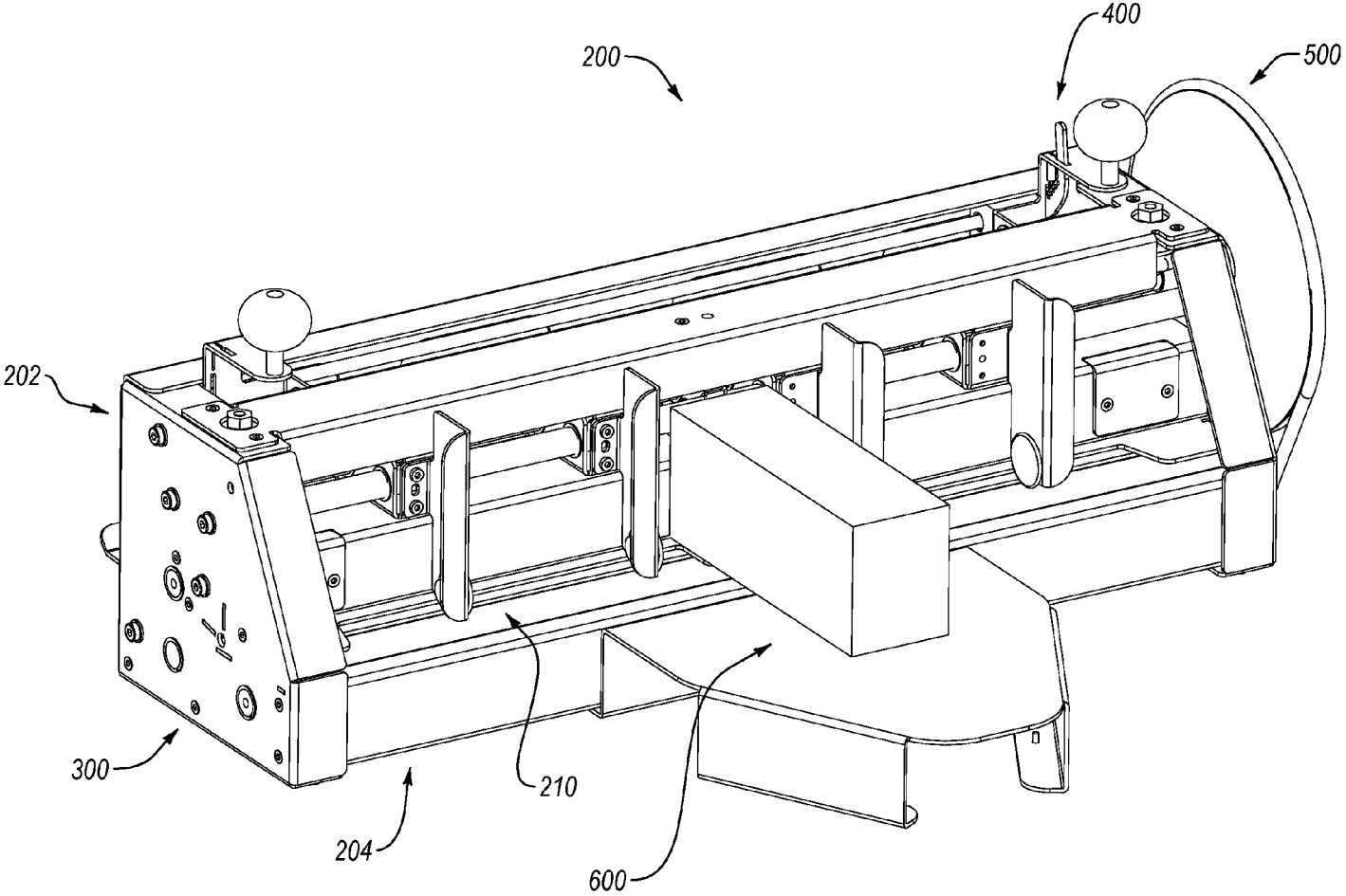
FIG. 3 illustrates a front perspective view of a converting machine useful in the packaging system of FIG. 1.

FIGS. 3-11 generally illustrate various aspects of converting machine 200 in greater detail. FIG. 3, for instance, illustrates a front perspective view of converting machine 200.

As illustrated in FIG. 3, converting machine 200 can include a frame 300, a conversion assembly 400, a feed assembly and/or advancing mechanism 500, and/or a receiving area 600. In at least one embodiment, frame 300 can be configured to structurally support conversion assembly 400 and/or advancing mechanism 500. In addition, receiving area 600 can be connected and/or disposed adjacent to conversion assembly 400. As discussed in further detail below, the proximity of receiving area 600 to conversion assembly 400 can allow for real-time measurement of the dimensions of item 110 during processing. In addition, front end 204 of converting machine 200 can have a packaging template outlet (opening) 210, which can be disposed in and/or (immediately) adjacent to receiving area 600.

Figure 4:
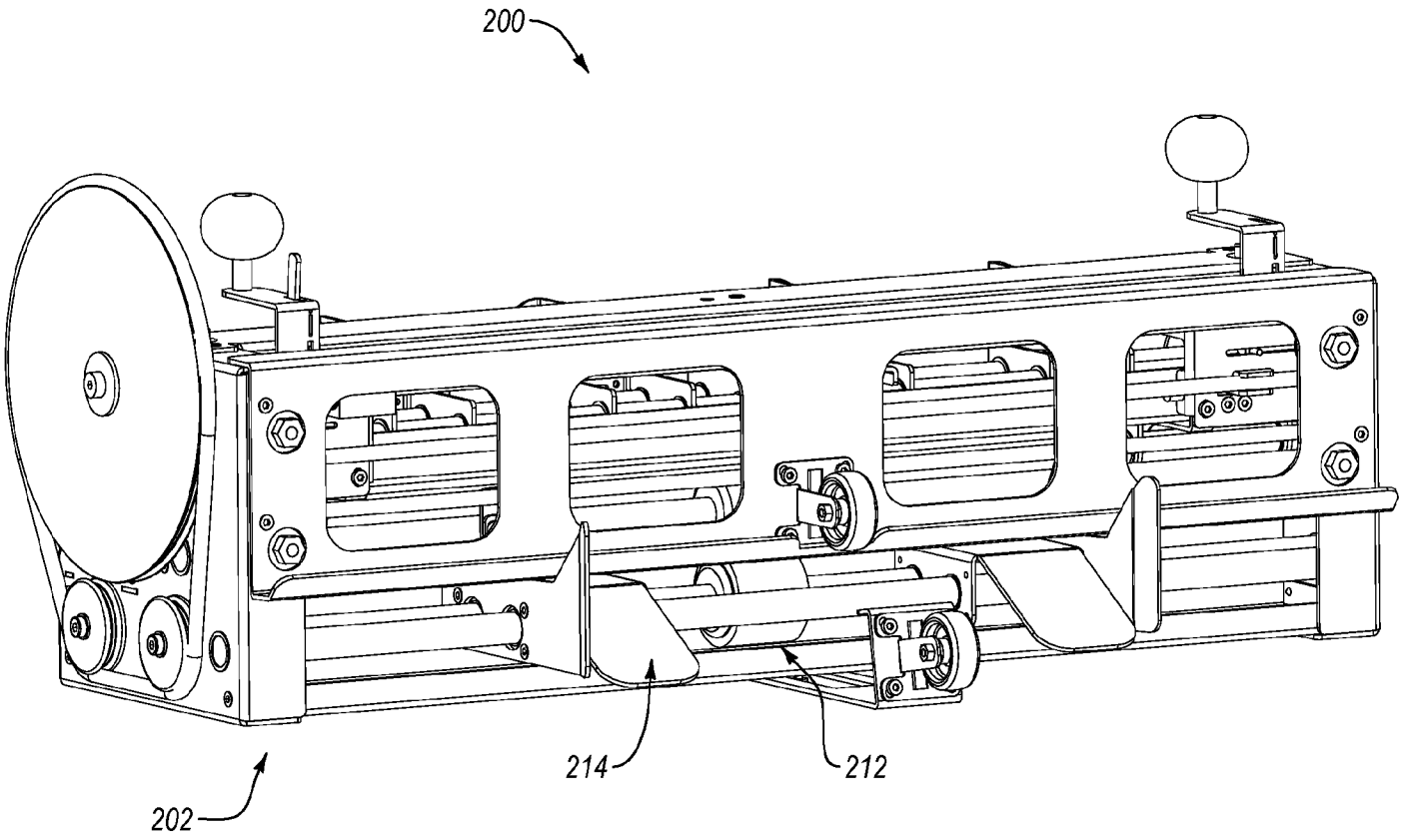
FIG. 4 illustrates a rear perspective view of the converting machine of FIG. 3.

FIG. 4 illustrates a rear perspective view of converting machine 200. Rear end 202 of converting machine 200 can have a sheet material inlet (opening) 212. Converting machine 200 can also have an inlet guide 214 disposed at rear end 202. In at least one embodiment, inlet guide 214 can ensure proper alignment of sheet material 104 upon entering converting machine 200. Inlet guide 214 can also continuously align feed supply 102 of sheet material 104 during processing and/or operation of converting machine 200.

Figure 5:
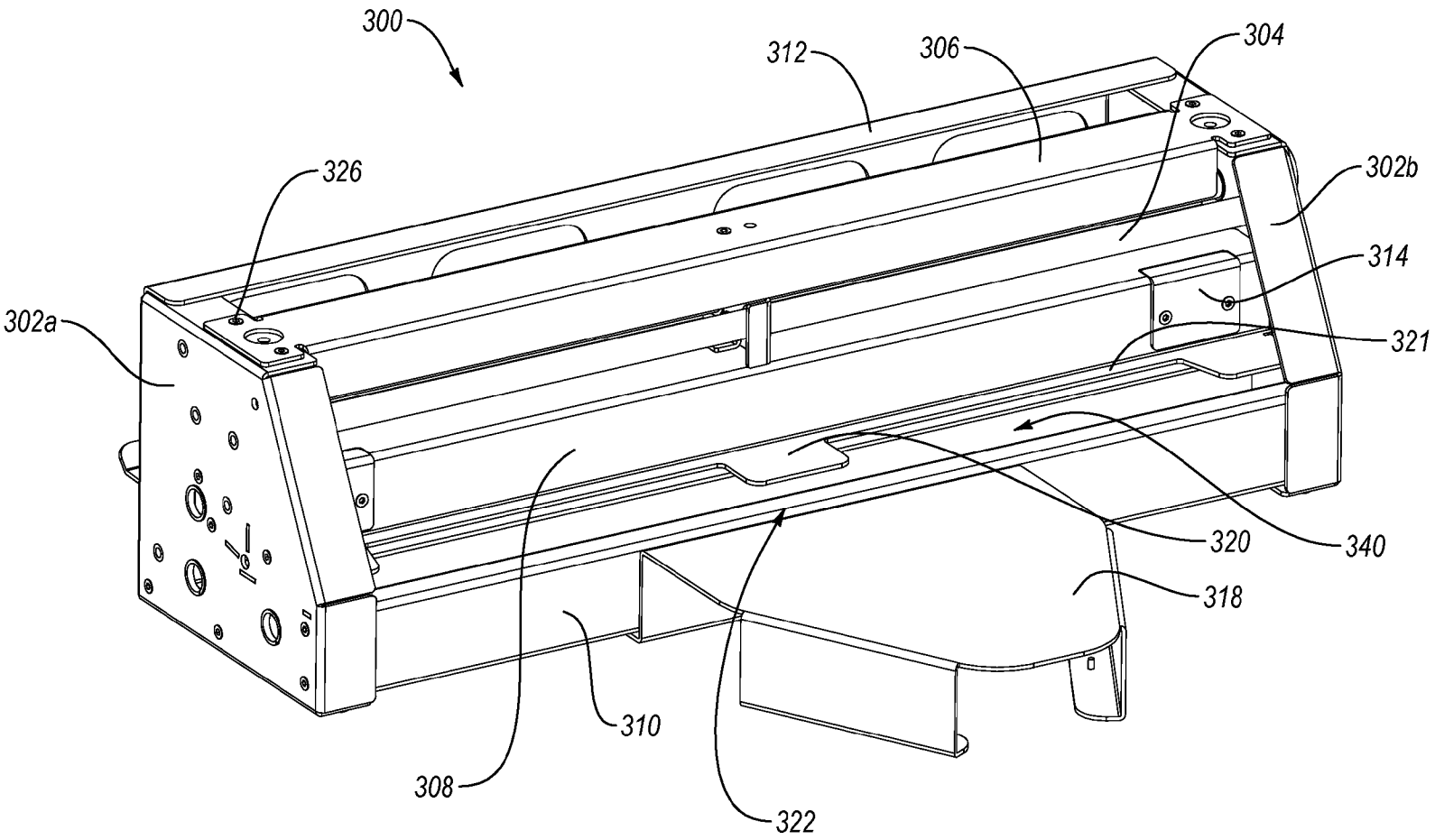
FIG. 5 illustrates a front perspective view of a frame useful in the converting machine of FIG. 3.

FIG. 5 illustrates an exemplary frame 300 of converting machine 200. Frame 300 can comprise a metal, such as aluminum, a metal alloy, a polymeric material, or any other suitable material. Frame 300 can be configured to provide structural support for converting machine 200 and/or a skeleton on or about which various components of converting machine 200, conversion assembly 400, and/or advancing mechanism 500 can be attached and/or connected.

In at least one embodiment, frame 300 can comprise one or more vertical frame elements 302. For instance, frame 300 can include vertical frame element 302*a* and opposing vertical frame element 302*b*. Frame 300 can also include one or more horizontal frame elements 304. Horizontal frame element 304 can comprise a transverse support member or cross bar extending between vertical frame elements 302*a* and 302*b*. Thus, horizontal frame element 304 can be attached and/or connected to vertical frame elements 302*a* and 302*b*. Frame 300 can also include one or more rear frame elements 312. Rear frame element 312 can also be disposed between vertical frame elements 302*a* and 302*b*.

Frame 300 can also include one or more safety features. For instance, frame 300 can have one or more upper shielding elements 306, intermediate shielding elements 308, and/or lower shielding elements 310. Shielding elements 306, 308, 310 can be disposed between vertical frame elements 302*a* and 302*b* and/or can provide a wall or barrier that substantially prevents (finger) access to components shielded thereby. In addition, shielding element 308 can provide a back-stop and/or reference point for positioning a first end of item 110 (e.g., during processing). As will be discussed in further detail below, one or more conversion functions can be performed on the sheet material in proximity to (e.g., immediately behind and/or within 2.54 cm of) shielding element 308.

In at least one embodiment, frame 300 can include one or more additional coverings (or plates) 314. Covering 314 can be selectively removable for quick access to a portion of converting machine 200 disposed therebehind. For instance, as will discussed in further detail below, converting machine 200 can comprise one or more sharpened blades or other cutting elements. One such cutting element can be disposed behind covering 314 such that access to the blade (e.g., for maintenance, repair, sharpening, or replacement thereof) can be afforded by removing covering 314 (without necessarily requiring removal of shielding element 308, for example).

Frame 300 can also include a platform 318. In at least one embodiment, platform 318 comprises an out-feed table for receiving a packaging template when the packaging template exits converting machine 200 via outlet 210 (see FIG. 3). Alternatively (or in addition), platform 318 can comprise a receiving table or receiving area 600 (see FIG. 3). In addition, frame 300 can include one or more risers (or product shelf) 320, including a (possibly smaller) horizontal extension 321 along the width of the machine. Riser 320 can be configured to receive an end portion of item 110 thereon in order to lift the end portion above a pre-determined level. In particular, riser 320 can be separated from platform 318 by a gap, space, and/or distance 322. Risers 320 can lift the end portion of item 110 above opening 340 of a frame 300. An elevation view of opening 340 is illustrated in FIG. 6.

Figure 6:
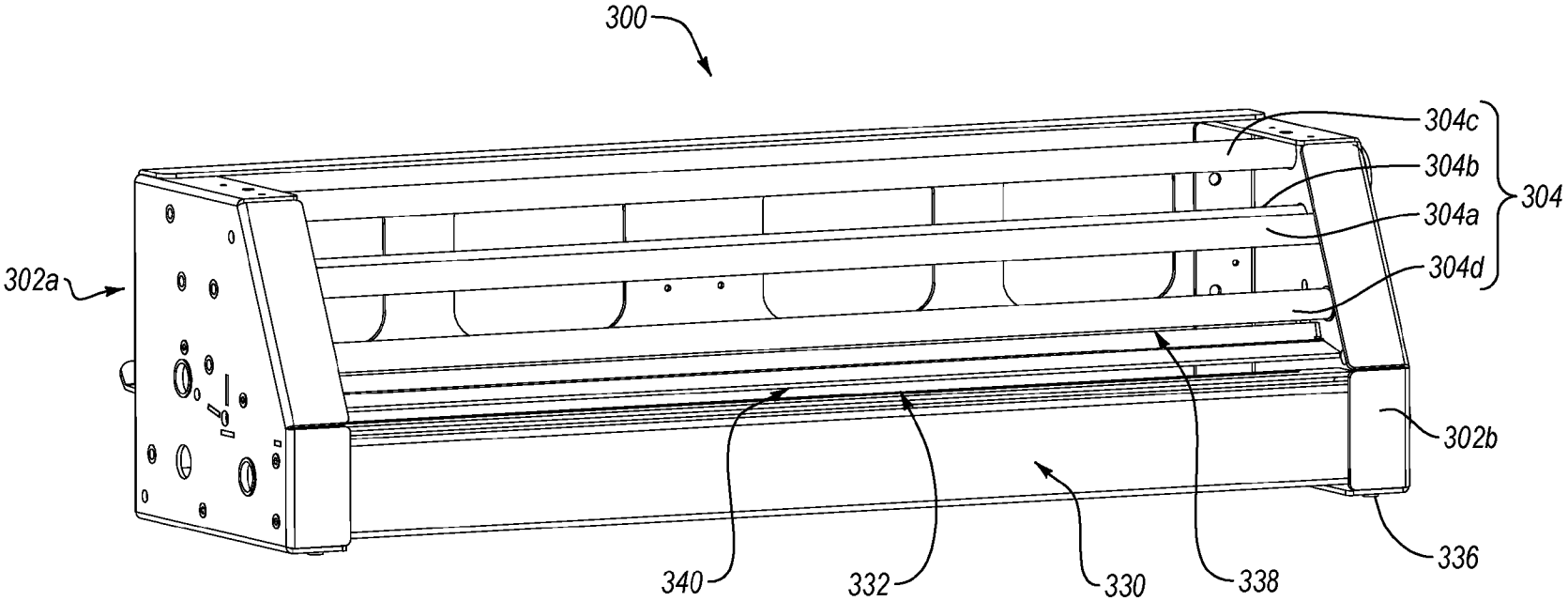
FIG. 6 illustrates a front perspective view of a portion of the frame of FIG. 5.

FIG. 6 illustrates a front perspective view of a frame 300 (wherein shielding elements 306, shielding element 308 (and coverings 314 thereof), and shielding element 310 of frame 300 have been removed). As illustrated in FIG. 6, frame 300 can also have one or more (inner) support plates 330 and (inner) feed guides 338. In some embodiments, opening 340 can be disposed between support plate 330 and feed guide 338. In particular, support plate 330 can have a guide member 332. Guide member 332 can comprise a lip, ledge, or other feature configured to direct the movement of sheet material 104 through converting machine 200, and possibly also accommodate an edge or groove to support the packaging material while one or more conversion functions (e.g., transverse conversion functions) are performed. Opening 340 can be disposed between the upper feed guide 338 and guide member 332 or the lower support plate 330. Support plate 330 and feed guide 338 can also be disposed between vertical frame elements 302*a* and 302*b*.

In addition, frame 300 can comprise a plurality of horizontal frame elements 304. For instance, FIG. 6 illustrates horizontal frame elements 304*a*, 304*b*, 304*c*, and 304*d*. As discussed in further detail below, horizontal frame elements 304*a*, 304*b*, 304*c*, and 304*d* can serve a variety of support functions for a variety of components of converting machine 200.

Figure 7:
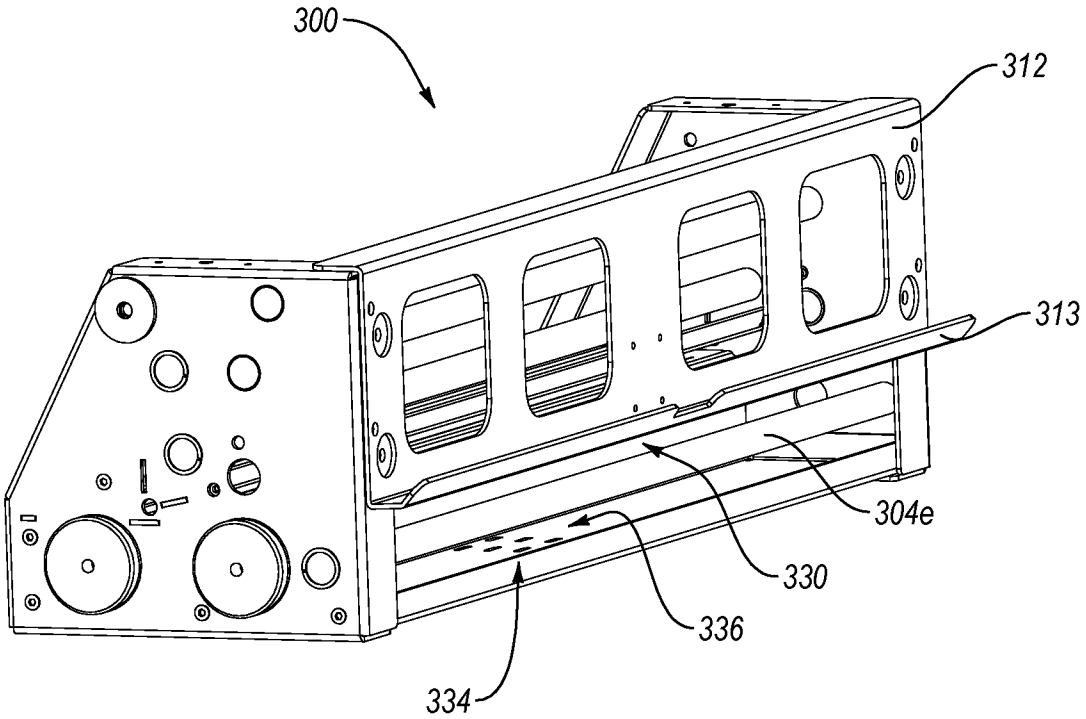
FIG. 7 illustrates a rear perspective view of the frame of FIG. 6.

FIG. 7 illustrates a rear perspective view of frame 300. As illustrated in FIG. 7, frame 300 can also include horizontal frame element 304*e*. In addition, frame 300 can include a rear support member 334 and/or a lower support member 336. In at least one embodiment, rear support member 334 and/or a lower support member 336 can be connected to and/or integral with support plate 330. Furthermore, rear frame element 312 can include guide member 313, which can be configured to direct the movement of sheet material 104 into converting machine 200.

Figure 8:
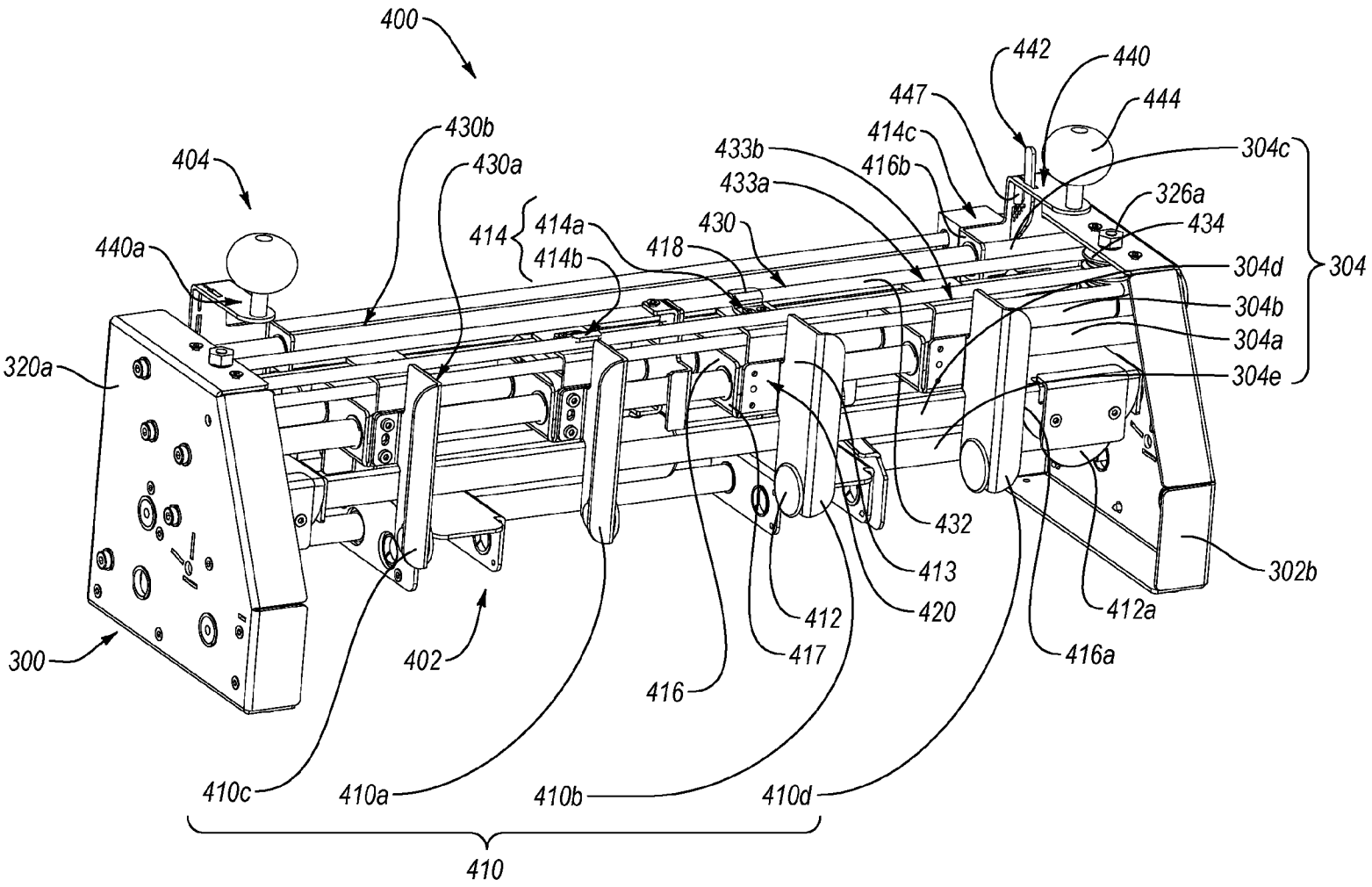
FIG. 8 illustrates a front perspective view of a conversion assembly in accordance with an embodiment of the present disclosure.

Turning now to FIG. 8, frame 300 (or vertical frame elements 302*a* and 302*b* thereof) can support conversion assembly 400 and/or be attached thereto. Conversion assembly 400 can include one or more longitudinal conversion assemblies 402 and/or one or more transverse conversion assemblies 404. Longitudinal conversion assembly 402 can comprise one or more longitudinal conversion elements (e.g., longheads) 410. As illustrated in FIG. 8, conversion assembly 400 (or longitudinal conversion assembly 402 thereof) comprises longitudinal conversion elements 410*a*, 410*b*, 410*c*, and 410*d*. One will appreciate, however, that one, two, three, five, six, or more longitudinal conversion elements 410 are also contemplated herein. In one or more embodiments, a set of longitudinal conversion elements 410 can comprise a pair of longitudinal conversion elements 410. Thus, conversion assembly 400 can comprise two sets of longitudinal conversion elements 410 in certain embodiments.

Longitudinal conversion elements 410 can comprise a longhead. Longheads can be configured to perform one or more longitudinal conversion functions, such as creasing, cutting, etc. It will be appreciate that reference to a longhead is intended to include and/or incorporate a specific reference to other longitudinal conversion elements as known in the art and/or described herein. For instance, longhead 410 can comprise a body portion 413 and/or one or more converting instruments 412. Body portion 413 can comprise a structural plate or bar. Converting instruments 412 can comprise a creasing element and/or cutting element in certain embodiments. As illustrated in FIG. 8, converting instruments 412 comprises a creasing wheel configured to performing a longitudinal creasing function on sheet material 104 when contacted by the same (e.g., as sheet material 104 is advanced longitudinally through converting machine 200).

Longitudinal conversion elements 410 can also comprise an attachment member 416. Attachment member 416 can be connected to (or configured to be connected to) one or more horizontal frame elements 304. For instance, as illustrated in FIG. 8, attachment member 416 can be connected to horizontal frame elements 304*a* and 304*b*. In at least one embodiment, the connection of a conversion element (or other component) to a plurality of horizontal frame elements 304 (e.g., cross members) can enhance stability and selective, transverse movement of the conversion element (or other component). In some embodiments, however, conversion elements (or other component) may only be connected to one cross member without departing from the scope of this disclosure.

Some embodiments can also include one or more glide bearings 417 disposed between attachment member 416 and horizontal frame element 304. A glide bearing 417 can prevent undesirable movement of attachment member 416 (and/or the component(s) connected thereto) about horizontal frame element 304. For instance, glide bearing 417 can permit certain transverse movements (e.g., those resulting from a transverse and/or horizontal force applied close enough to horizontal frame element 304), while substantially prohibiting and/or inhibiting other transverse movements (e.g., those resulting from a transverse and/or horizontal force applied too far distant from horizontal frame element 304).

Figure 9:
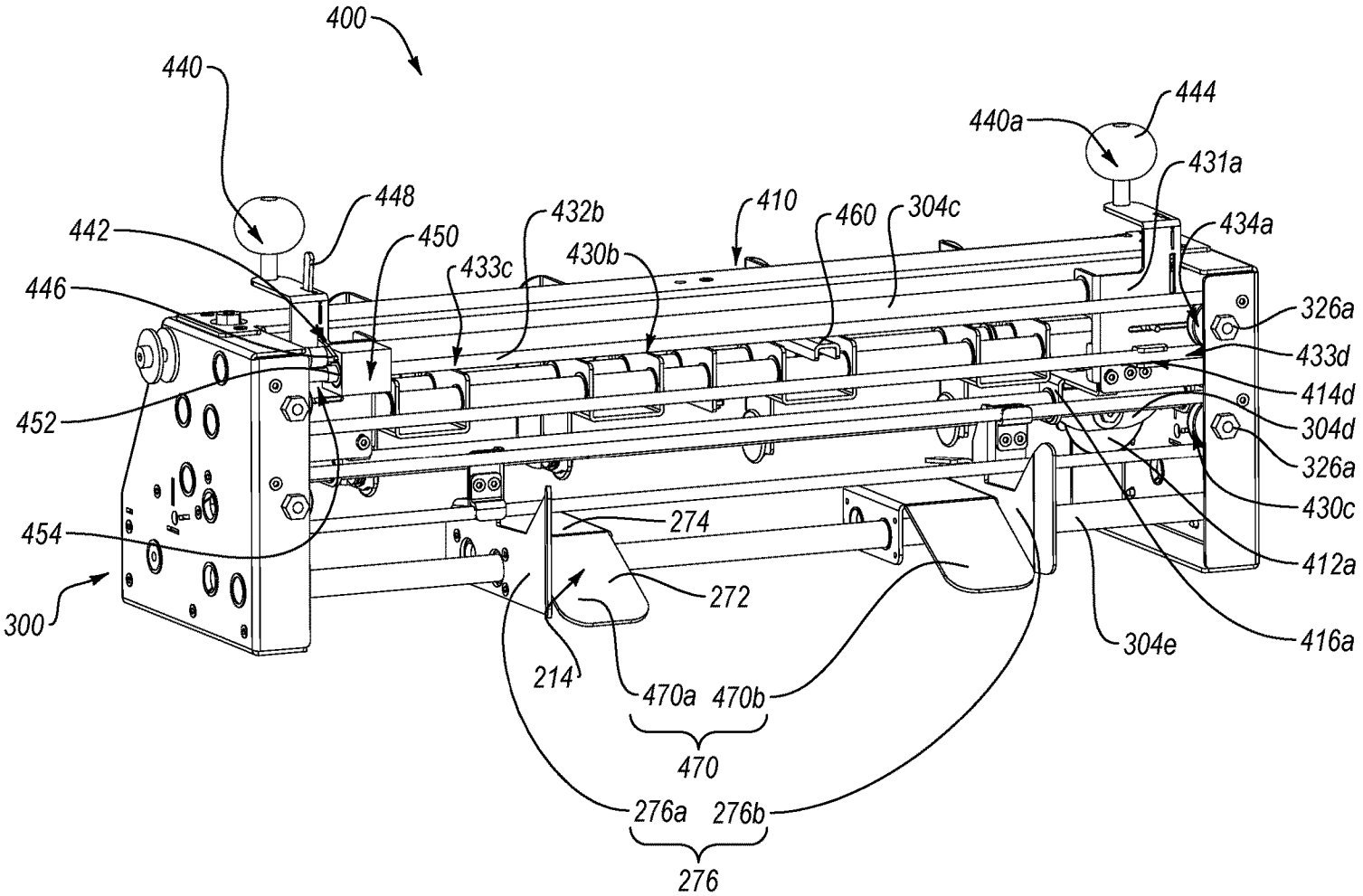
FIG. 9 illustrates a rear perspective view of the conversion assembly of FIG. 8.

Certain embodiments can also include one or more symmetrical movement assemblies and/or apparatus (e.g., connected to frame 300 and/or disposed between vertical frame elements 302*a* and 302*b* thereof). As illustrated in FIGS. 8 and 9, symmetrical movement apparatus 430 can comprise a pulley system or other means for coordinating symmetrical and/or simultaneous movement of a plurality of components of system 100 and/or converting machine 200. Symmetrical movement apparatus 430 can comprise a line 432. Line 432 can comprise a cable, wire, or other suitable pulley line. Symmetrical movement assembly 430 can also comprise a multi-directional element 434. For instance, multi-directional element 434 can comprise a pulley wheel in some embodiments. One will appreciate, however, that the symmetrical movement assembly 430 of the present disclosure is not limited to pulley systems. For instance, hydraulic, pneumatic, electric, mechanical, coordinated, and other suitable symmetrical movement assemblies and/or apparatus are also contemplated herein. In at least one embodiment, symmetrical movement assembly 430 can be connected to frame 300 (or vertical frame elements 302*a* and/or 302*b* thereof) via one or more fasteners 326*a*.

In at least one embodiment, symmetrical movement assembly 430 can be configured to coordinate the simultaneous and/or symmetrical (e.g., equal and opposite) movement of a pair of longitudinal conversion elements 410. Longitudinal conversion elements 410 can be connected to symmetrical movement assembly 430 via one or more attachment mechanism 414. For instance, as illustrated in FIG. 8, longitudinal conversion elements 410*a* and 410*b* can be connected to and/or coordinated by a first symmetrical movement assembly 430. Specifically, a first attachment mechanism 414*a* can attach first inner longitudinal conversion element 410*a* to a first portion of symmetrical movement assembly 430 (e.g., to a first portion 433*a* of line 432). Attachment mechanism 414*a* can include a clamp or other fastener 418 and can be connected to body portion 413 via connector 420. Likewise, a second attachment mechanism 414*b* can attach second inner longitudinal conversion element 410*b* to a second portion of symmetrical movement assembly 430 (e.g., to a second portion 433*b* of line 432). In at least one embodiment, movement of first inner longitudinal conversion element 410*a* in a first direction can cause (an equal and opposite) movement of second inner longitudinal conversion element 410*b* in a second direction.

A similar arrangement can cause symmetric movement of first outer longitudinal conversion element 410*c* and second outer longitudinal conversion element 410*d* via a second symmetrical movement assembly 430*a* (e.g., similarly configured and/or disposed adjacent to symmetrical movement assembly 430). Furthermore, as discussed in further detail below, components of transverse conversion assembly 404 can also be coordinated via a symmetrical movement assembly 430*b*.

Transverse conversion assembly 404 can include one or more transverse conversion elements 440. In some embodiments, transverse conversion element 440 can comprise a crosshead. Such crossheads can be configured to perform one or more transverse conversion functions, such as cutting, creasing, etc. It will be appreciated that reference to a crosshead is intended to include and/or incorporate a specific reference to other transverse conversion elements as known in the art and/or described herein. Crosshead 440 can comprise a body portion 413*a* and/or one or more converting instruments 412*a*. Converting instrument 412*a* can comprise a creasing element and/or cutting element in certain embodiments.

As illustrated in FIG. 8, converting instruments 412*a* comprises a cutting wheel configured to performing one or more transverse cutting functions on sheet material 104 when contacted by the same (e.g., as converting instrument 412*a* is advanced transversely across or about sheet material 104). As discussed briefly above, converting instrument 412*a* can be positioned and/or disposed proximal to (e.g., immediately behind and/or within 2.54 cm of) shielding element 308. For instance, converting instrument 412*a* can be positioned and/or disposed less than and/or about 2.54 cm, 2 cm, 1.5 cm, 1.27 cm, 1 cm, 0.75 cm, 0.5 cm, or 0.25 cm. Accordingly, at least a portion of receiving area 600 can be disposed less than about 2.54 cm, 2 cm, 1.5 cm, 1.27 cm, 1 cm, 0.75 cm, 0.5 cm, or 0.25 cm from converting instrument 412*a* and/or the portion of the transverse width along which the converting instrument 412*a* is moveable. This proximity between the receiving area where the item is placed and the transverse converting instruments can be important in order to enable a direct visual indication for manual feeding, as described in more detail below.

Transverse conversion element 440 can also comprise an attachment member 416*a*. Attachment member 416*a* can be connected to (or configured to be connected to) one or more horizontal frame elements 304. For instance, as illustrated in FIG. 8, attachment member 416*a* can be connected to horizontal frame element 304*d*. Transverse conversion element 440 can also comprise a second attachment member 416*b* (e.g., connected to (or configured to be connected to) horizontal frame element 304*c*). In some embodiments, however, transverse conversion element 440 may only be connected to one cross member without departing from the scope of this disclosure.

Transverse conversion element 440 can also be connected to symmetrical movement assembly 430*b* via one or more attachment mechanisms 414*c*. Symmetrical movement assembly 430*b* can comprise a pulley system having a line 432*b* and pulley wheels 434*a* connected to frame 300 (or vertical frame elements 302*a* and/or 302*b* thereof) via one or more fasteners 326*a*. In at least one embodiment, transverse conversion element 440 can be selectively released from symmetrical movement assembly 430*b* via one or more release mechanisms 442. Transverse conversion element 440 can also include a handle 444.

Transverse conversion assembly 404 can also include a second transverse conversion element 440*a*. Transverse conversion elements 440 and 440*a* can have identical, similar, or different configuration in various embodiments of the present disclosure. For instance, as illustrated more fully in FIG. 9, transverse conversion element 440*a* can also include a body portion 413*a*, a converting instrument 412*a*, a first attachment member 416*a* connected to horizontal frame element 304*d*, a second attachment member 416*a* connected to horizontal frame element 304*c*, and a handle 444. In at least one embodiment, however, transverse conversion element 440*a* can be connected to symmetrical movement assembly 430*b* via one or more attachment mechanisms 414*d*. Moreover, transverse conversion element 440*a* can lack a release mechanism 442 in some embodiments. Thus, movement of transverse conversion element 440 can cause an equal and opposite movement of transverse conversion element 440*a* when both are attached to symmetrical movement assembly 430*b*. However, when transverse conversion element 440 is selectively released or disconnected from symmetrical movement assembly 430*b* via operation of release mechanisms 442, transverse conversion elements 440 and 440*a* can move independent of one another.

In at least one embodiment, attachment mechanisms 414*c* can comprise a cone-and-socket configuration. For instance, as illustrated in FIG. 9, attachment mechanisms 414*c* can comprise a socket 450 and an insert 452 (e.g., ball, cone, etc.). Socket 450 can have a cavity 454 into which insert 452 can be inserted and/or disposed. Upon insertion of insert 452 into cavity 454 of socket 450, locking mechanism 446 can be engage (e.g., via one or more springs 447 or other engagement mechanism). Engaged locking mechanism 446 can inhibit and/or substantially prevent insert 452 from exiting cavity 454 of socket 450 without first disengaging locking mechanism 446.

Accordingly, release mechanisms 442 can disengage locking mechanism 446. Release mechanisms 442 can comprise a latch or other locking mechanism 446 and a trigger or other release member 448. In at least one embodiment, socket 450 can be connected to transverse conversion element 440 or body portion 413*a* thereof. In addition, insert 452 can be connected to line 432*b* and/or a first portion 433*c* thereof. Furthermore, transverse conversion element 440*a* can be connected to a second portion 433*d* of line 432*b* via attachment mechanism 414*d*.

In at least one embodiment, a stopping mechanism 460 can be provided (e.g., on longitudinal conversion element 410 or, specifically, 410*a*) by which one or more of transverse conversion elements 440 and 440*a* can be substantially prevented from passing transversely. For instance, stopping mechanism 460 can be disposed in the transverse path of transverse conversion elements 440*a* (e.g., between an outer position and an inner position). Thus, in one or more embodiments, stopping mechanism 460 can be configured to substantially prevent transverse conversion element 440*a* and/or converting instruments 412*a* thereof from advancing inward past at least a portion of longitudinal conversion element 410. Consequently, the transverse conversion function(s) can be limited portions of sheet material 104 flanking longitudinal conversion elements 410.

As will be discussed in further detail below, the transverse conversion function(s) can comprise cutting sheet material 104 (e.g., to form one or more flaps). Accordingly, limiting the range of motion of transverse conversion element 440*a* can prevent transverse conversion element 440*a* and/or converting instruments 412*a* from cutting entirely through sheet material 104 and severing and/or separating the same from feed stock 102. However, in at least one embodiment, one or more of transverse conversion elements 440 and 440*a* can be configured to avoid stopping mechanism 460 in order to perform at least one transverse conversion function beyond or past stopping mechanism 460 (e.g., across the entire width of sheet material 104 and/or conversion assembly 400. For instance, transverse conversion element 440 can be configured to move (freely) past stopping mechanism 460 in at least one embodiment.

Thus, while transverse conversion element 440*a* can be blocked by stopping mechanism 460 such that converting instruments 412*a* thereof can only advance to (but not beyond) longitudinal conversion element 410, transverse conversion element 440 can slide across the entire transverse width of conversion assembly 400 in some embodiments. One will appreciate that transverse conversion element 440 may need to be detached from symmetrical movement assembly 430*b* in order to slide across the entire transverse width of conversion assembly 400. Moreover, stopping mechanism 460 can also be disengaged in at least one embodiment such that transverse conversion element 440*a* can pass thereby.

FIG. 9 further illustrates inlet guide 214 connected to horizontal frame element 304*e* and symmetrical movement assembly 430*c*. Inlet guide 214 can be adjustably mounted to horizontal frame element 304*e* such various different sizes of sheet material can be received thereby. For instance, in some embodiments, inlet guide 214 can comprise opposing guides 470 (e.g., each having a sloped portion 272 and/or a longitudinal portion 274) and horizontal frame element 304*e* can comprise a crossbar. Opposing guides 470*a* and 470*b* can be slideably mounted to the crossbar such that when opposing guides 470*a* and 470*b* are slid proximally or closer together (e.g., by means of symmetrical movement assembly 430*c*), inlet guide 214 can be configured to receive a sheet material having a smaller transverse width. Similarly, when opposing guides 470*a* and 470*b* are slid distally or further apart, inlet guide 214 can be configured to receive a sheet material having a larger transverse width. Inlet guide 214 can also include a locking mechanism (not shown) configured to prevent (transverse outward and/or inward) movement of opposing guide(s) 470.

In addition, inlet guide 214 can also comprise outer guide walls 276 configured for aligning and/or retaining sheet material 104. For instance, guide 470*a* can include an outer guide wall 276*a* and opposing guide 470*b* can include an outer guide wall 276*b*. Outer guide walls 276*a* and 276*b* can prevent sheet material 104 from shift or sliding transversely about the width of converting machine 200 and/or from twisting or torqueing in a transverse direction, e.g. while sheet material 104 is advanced forward. In other words, outer guide walls 276*a* and 276*b* can ensure that sheet material 104 is advanced forward in a straight line or angle.

Figure 10:
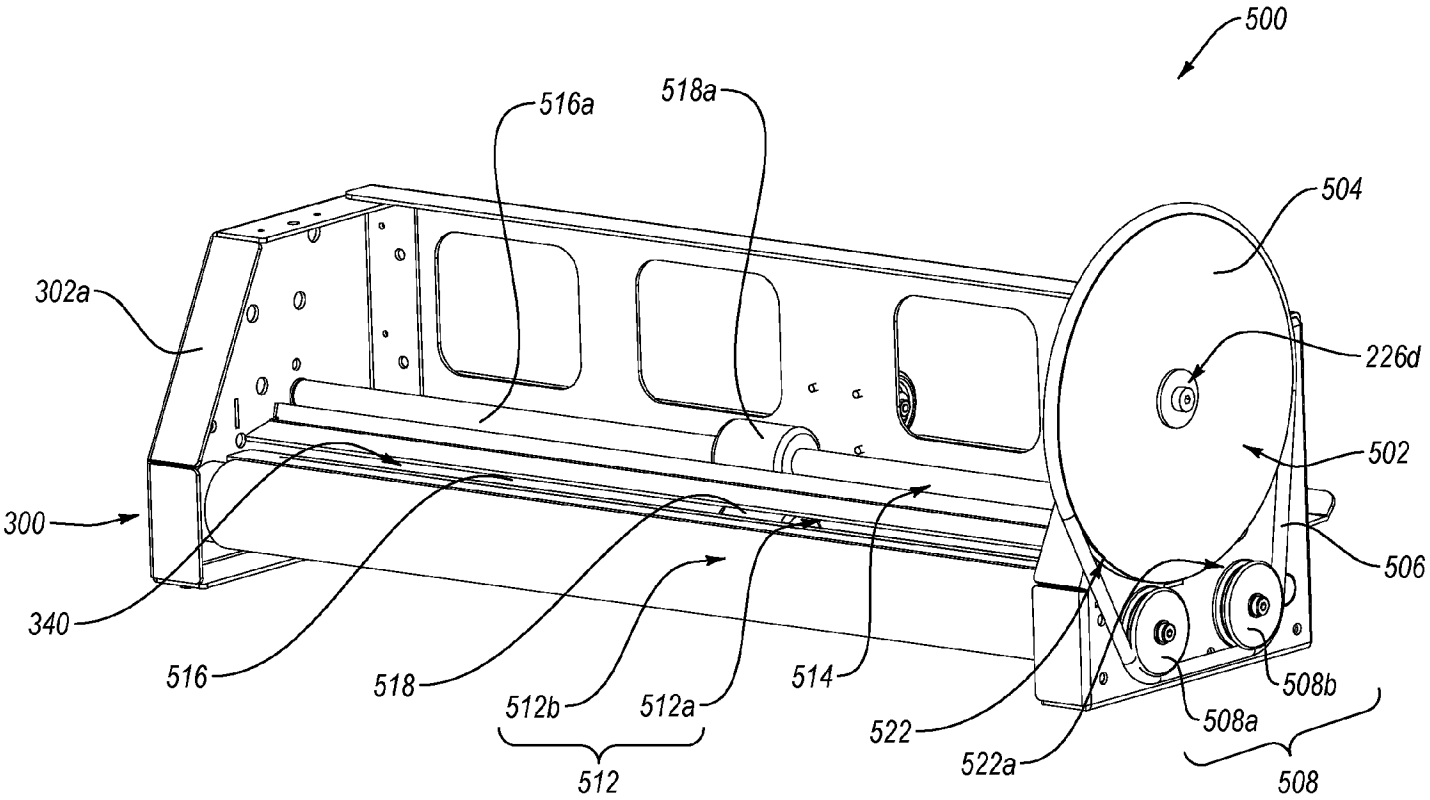
FIG. 10 illustrates a front perspective view of an advancing mechanism in accordance with an embodiment of the present disclosure.

Turning now to FIG. 10, frame 300 can support advancing mechanism 500. Advancing mechanism 500 can be configured to move or advance sheet material 104 through converting machine 200 and/or conversion assembly 400 thereof. Advancing mechanism 500 can be (entirely) manually operated, electrically operated, automatically operated, and/or any suitable combination thereof. For instance, sheet material 104 can be fed or loaded into converting machine 200 manually by an operator 101 manually rotating (or cranking) one or more components of advancing mechanism 500. Upon pre-setting the system (e.g., by manually feeding sheet material 104 to a starting position), one or more automatic process steps can be initiated by the user 101. Furthermore, one or more embodiments can include one or more automated processing steps triggered by the completion of previously initiated (automated) processing steps. Automation can include the use of one or more sensors, circuits, series, control panels, user interfaces, CPUs, computer processors, and/or other electrical and/or mechanical components.

As shown in FIG. 10, advancing mechanism 500 can include one or more crank assemblies 502 and/or one or more roller assemblies 512. Crank assembly 502 can comprise a crank member 504 and a translational element 506. As illustrated in FIG. 10, crank member 504 can comprise a wheel, disk, or other rotational element. One will appreciate, however, that the present disclosure is not so limited. For instance, crank member 504 can comprise a handle, bar, rod, block, ball, or any other suitable crank member.

Crank member 504 can comprise teeth or a grove 522 configured to receive translational element 506. For instance, translational element 506 can comprise a band, gear, toothed belt or chain, strap, or other member configured to translate movement from one component to another. Thus, (rotational) movement of crank member 504 can be translated to one or more roller assemblies 512 by means of translational element 506. For instance, translational element 506 can also be connected to roller cranks 508*a* and 508*b* (e.g., via a grove 522 thereof). In at least one embodiment, roller cranks 508*a* and 508*b* can be connected to roller shaft 516 having one or more roller members 518 thereon. Those skilled in the art will appreciate that rotation of crank member 504 can cause rotational movement of roller members 518. Roller members 518 can be adapted for advancing sheet material 104 through converting machine 200 (and/or conversion assembly 400 thereof) and/or through opening 340.

Furthermore, advancing mechanism 500 can include one or more pressure rollers 514 configured to press sheet material 104 against roller assembly 512*a* to enhance the movement induced thereby. For instance, pressure roller 514 can comprise a roller shaft 516*a* supporting a roller member 518*a* configured to press sheet material 104 against roller member 518 of roller assembly 512. Thus, when roller assembly 512 rotates forward (top-forward, counter-clockwise from a right-side view, etc.), sheet material 104 can be advanced through converting machine 200 (and/or conversion assembly 400 thereof) and/or through opening 340 by means of the rolling motion of roller members 518 and 518*a*.

Roller assembly 512*b* can further enhance movement of sheet material 104 through opening 340. For instance, rotation of crank member 504 can cause rotational movement of roller assembly 512*b* in concert with roller assembly 512*a*. Accordingly, when sheet material 104 is advanced through converting machine 200 (and/or conversion assembly 400 thereof), roller assembly 512*b* can promote the longitudinal movement of sheet material 104 through opening 340.

Figure 11:
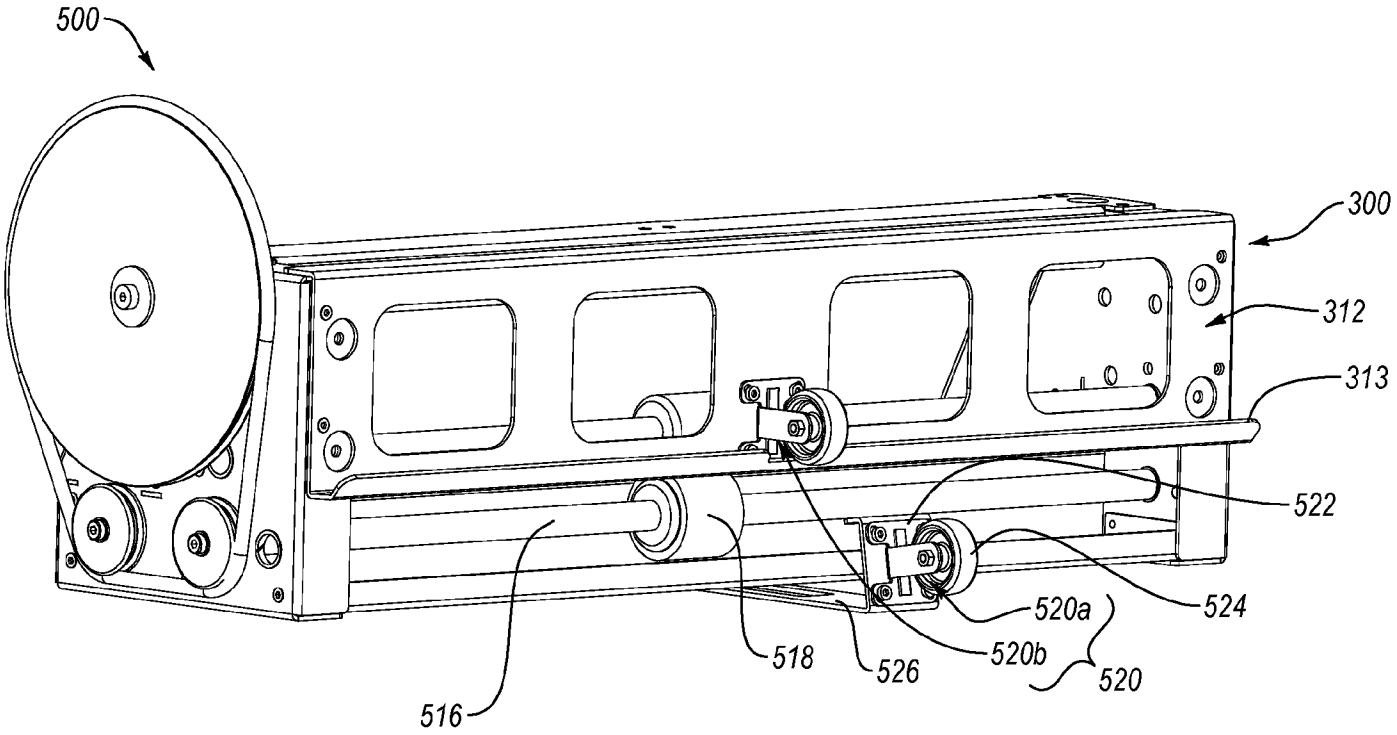
FIG. 11 illustrates a rear perspective view of the advancing mechanism of FIG. 10.

As illustrated more fully in FIG. 11, advancing mechanism 500 can also include one or more roller guide assemblies 520 for enhancing the ease of insertion of the sheet material 104 into converting machine 200 (and/or conversion assembly 400 thereof). Roller guide assembly 520*a*, for example, comprises a guide wheel 524 connected to a support arm 526 via bracket 522. Guide wheel 524 can rotate about its axis of rotation to thereby promote the feeding of sheet material 104 toward conversion assembly 400. In particular, guide wheel 524 can ensure that sheet material 104 is raised or lifted to a position suitable for feeding into converting machine 200. An upper guide wheel 524 of roller guide assembly 520*b* can similarly ensure that sheet material 104 is depressed or held down to a position suitable for feeding into converting machine 200. Thus, roller guide assembly 520*a* and 520*b* can work in concert to properly vertically position sheet material 104 for entry in converting machine 200. One will appreciate, however, that other configurations for roller guide assembly 520 are also contemplated herein. In some embodiments, guide member 313 of rear frame element 312 can also comprise part of advancing mechanism 500.

Figure 12:
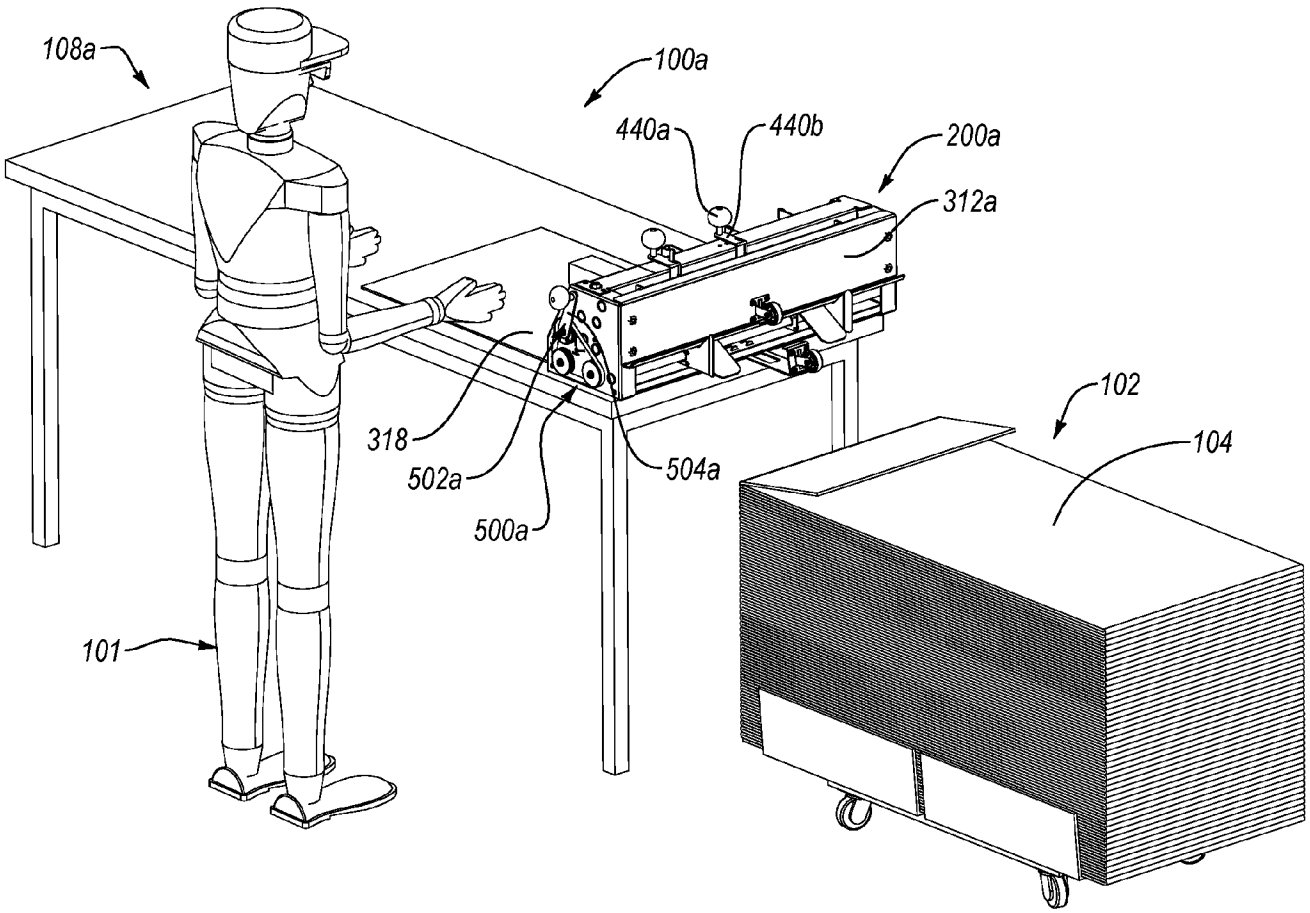
FIG. 12 illustrates a perspective view of another packaging system in accordance with an embodiment of the present disclosure.

FIG. 12 illustrates an alternative embodiment comprising a system 100*a*. System 100*a* can include one or more feed supplies 102 of sheet material 104. System 100*a* can also include a converting machine 200*a*. In many aspects, converting machine 200*a* can be configured similar to converting machine 200. However, a few notable alternative configurations can be implemented in converting machine 200*a*. For instance, converting machine 200*a* can include one or more transverse conversion elements 440*b* having a handle 444*a* thereof disposed toward the front end of converting machine 200*a*. In addition, rear frame element 312*a* can comprise a solid (e.g., un-slotted) configuration. Moreover, converting machine 200*a* can include an advancing mechanism 500*a* comprising a crank assembly 502*a* having a crank member 504*a*. Crank member 504*a* can include a crank arm and ball configuration instead of a crank wheel configuration as in crank member 504.

Furthermore, converting machine 200*a* can be attached, connected, and/or mounted to support structure 108*a* such that platform 318*a* can be planar with the surface of support structure 108*a*, or even completely removed (and replaced by 108*a*). Converting machine 200*a* can also be attached, connected, and/or mounted to support structure 108*a* such that user 101 can stand to the side thereof (instead of in front of converting machine 200 as in system 100). Accordingly, access to handles and grips or other components (e.g., for feeding, guiding, and/or advancing sheet material 104, positioning of longheads 410 and/or crossheads 440, guiding, measuring, and/or marking positions, dimensions, and/or measurements, and/or other functional components or mechanisms) can be appropriately adjusted. One advantage of this embodiment is that the outfeed area (adjacent to receiving area 600) can also serve or function as a packaging or packing area, thus saving space and even handling (e.g. since there is no longer any need to substantially move ready or completed packaging template 112, nor the item to be packaged. Depending on packaging design, the item might, in fact, just be slid off the riser 320 (product shelf) and automatically dropped down on the packaging that now can be closed without any lifting. Those skilled in the art will appreciate a variety of variations and additional advantages for such a configuration, all of which are contemplated herein.

Figure 13:
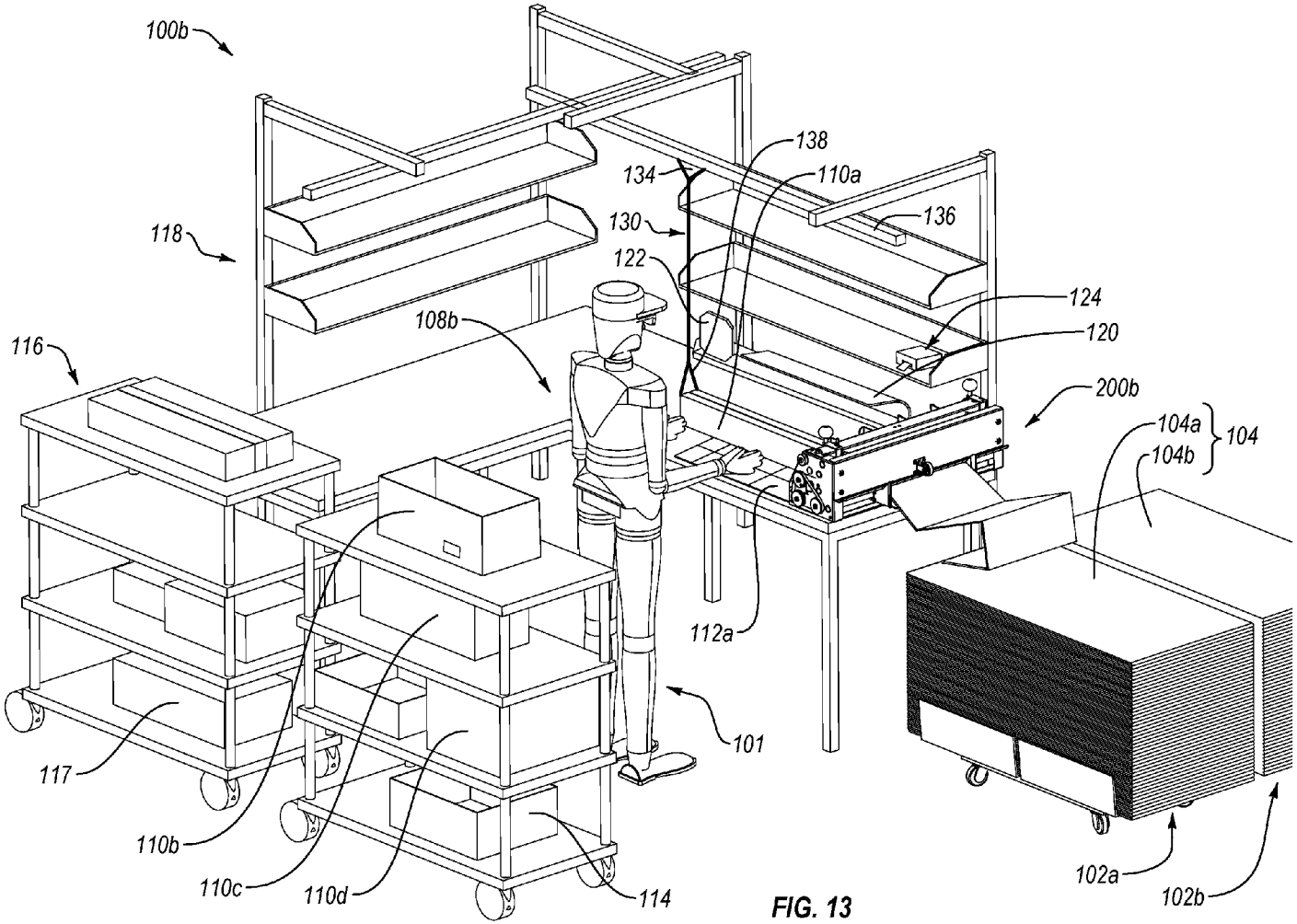
FIG. 13 illustrates a perspective view of another packaging system in accordance with an embodiment of the present disclosure.

FIG. 13 illustrates another alternative embodiment comprising a system 100*b*. System 100*b* can include one or more feed supplies 102 of sheet material 104 and/or one or more converting machines 200*b*. In at least one embodiment, sheet material 104*a* can be fed into converting machine 200*b* by user 101 and processed therein to produce packaging template 112*a*. Converting machine 200*b* can be mounted, connected, and/or attached to a support structure 108*b*. For instance, packaging template 112*a* can exit converting machine 200*b* and/or be released therefrom in planar alignment with the surface of support structure 108*b*. Converting machine 200*b* can be mounted, connected, and/or attached to a support structure 108*b* such that user 101 can stand to the side thereof (instead of in front of converting machine 200 as in system 100).

Support structure 108*b* can include shelving 118 and/or suspension system 130. Suspension system 130 can comprise a line 132 suspended from a frame 136. In at least one embodiment, frame 136 can include a connection element 134 slideably attached to (a first end of) line 132 and to frame 136 (e.g., along a sliding track). Line 132 can have a support member 138 connected to an end thereof (e.g., opposite the first end). Other embodiments could include a rotating or linear guided plate that can be positioned along the feeding direction in the extension of the receiving area. In some embodiments, suspension system 130 can at least partially lift and/or separate item 110*a* from (the surface of) support structure 108*b*. For instance, support member 138 can be positioned at the end of item 110*a* (opposite converting machine 200*b* and/or the end of item 110*a* positioned in the receiving area thereof. The longitudinal position of support member 138 can be slidedly altered to accommodate, receive, and/or lift a variety of items 110 having any suitable longitudinal length. In at least one embodiment, sheet material 104 can more easily move beneath item 110*a* when lifted and/or separated from the surface of support structure 108*b*.

System 100*b* can also include one or more carts 116. Cart(s) 116 can be used to hold one or more additional items 110 thereon. For instance, items 110*b*, 110*c*, and/or 110*d* can be positioned on cart(s) 116. In addition, cart(s) 116 can be used to hold one or more packaged items 117. In at least one embodiment, packaged item 117 can include item 110*a* disposed within a box formed and/or assembled from one or more packaging templates 112*a*. Packaged item 117 can also be covered in wrapping 120 and/or taped (closed) with tape (or other adhesive) 124.

As illustrated in FIGS. 14A-14D, converting machine 200*b* can be configured similar to converting machine 200 and/or 200*a*. However, a few notable alternative configurations can be implemented in converting machine 200*b*. For instance, converting machine 200*b* can include a transverse conversion element 440*c* having a handle 444*b* thereon. However, in at least one embodiment, opposing transverse conversion element 440*d* does not include a handle thereon. Converting machine 200*b* can also include at least one longitudinal conversion element 410*e* having an extended configuration. For instance, the height of longitudinal conversion element 410*e* can exceed the height of opposing longitudinal conversion element 410*a* and/or of corresponding longitudinal conversion element 410*b* of converting machine 200).

In at least one embodiment, converting machine 200*b* can also include a measuring mechanism 700. Measuring mechanism 700 can comprise a ruler, (retractable) measuring tape, marking strip, lighting element (or light-generating element) or other means for measuring (e.g., the distance between two points). Measuring mechanism 700 can be attached, connected, and/or mounted to longitudinal conversion element 410*e* in some embodiments. For instance, measuring mechanism 700 can include a ruler attached to longitudinal conversion element 410*e* and/or a marking element 704 (e.g., slideably connected to longitudinal conversion element 410*e*).

In certain embodiments, marking element 704 can be adjustable along the height of longitudinal conversion element 410*e*. For instance, marking element 704 can be configured to slide (vertically) about longitudinal conversion element 410*e* and slidedly abut and/or rest atop item 110*e* (e.g., such that the height of item 110*e* is marked and/or measured thereby). Importantly, the (actual) height of (the physical) item 110*e* can be used to determine the position of marking element 704. In other words, marking element 704 can (actually) be positioned against the top surface of item 110*e*. It will also be appreciated that marking element 704 can placed in a position corresponding to the top surface of item 110*e* without departing from the scope of this disclosure.

In at least one embodiment, measuring mechanism 700 can be configured to recapitulate and/or translate the measurement of the height of item 110*e* to a longitudinal length of similar or same distance and/or amount. For instance, measuring mechanism 700 can extend longitudinally from the front of converting machine 200*b* in some embodiments. Measuring mechanism 700 can also comprise an optional marking element 704. Accordingly, the measurement of the height of item 110*e* can be marked and/or measured out longitudinally in certain embodiments. For instance, the measurement of the height of item 110*e* can be marked and/or measured out longitudinally from a converting instrument of transverse conversion element 440*c*, for example. Thus, a measurement corresponding to the height of item 110*e* can be measured from the point and/or site of a transverse conversion function.

In at least one embodiment, measuring mechanism 700 can be configured to recapitulate and/or translate the measurement of the height of item 110*e* to a transverse length of similar or same distance and/or amount. For instance, measuring mechanism 700 can extend transversely from longitudinal conversion element 410*f* and/or 410*e* in some embodiments. Accordingly, the measurement of the height of item 110*e* can be marked and/or measured out transversely in certain embodiments. For instance, the measurement of the height of item 110*e* can be marked and/or measured out transversely from converting instrument 412*a* of longitudinal conversion element 410*e*, for example. Thus, in some embodiments, longitudinal conversion elements 410*f* and 410*e* (and/or converting instruments 412*a* and 412*b* thereof) can be separated by a measurement corresponding to the height of item 110*e* by deploying and/or adjusting one or more measuring mechanisms 700 to corresponding positions.

As illustrated in FIGS. 14A-14D, measuring mechanism 700 can comprise a lighting element 702. Lighting element 702 can be battery-powered, electrically powered (by a power cord), and/or otherwise operated. Lighting element 702 can produce and/or project a laser or other form (e.g., beam) of light 706. For instance, lighting element 702 can be configured and/or calibrated to project a first beam 706*a* from measuring mechanism 700 (generally) transversely (and downward) toward packaging template 112*b*. Specifically, first beam 706*a* can intersect with packaging template 112*b* at a position and/or location that is separated from converting instrument 412*a* of longitudinal conversion element 410*e* (e.g., by a distance corresponding to (e.g., similar or equal to) the height of item 110*e*). Accordingly, first beam 706*a* can mark a location for (accurately) positioning longitudinal conversion element 410*f* and/or converting instrument 412*b* thereof a distance from (the position of) longitudinal conversion element 410*e* and/or converting instrument 412*a* thereof. In at least one embodiment the distance can correspond to the height of item 110*e*. Thus, longitudinal conversion elements 410*e* and 410*f* (or converting instruments 412*a* and 412*b* thereof) can produce longitudinal conversion function(s) that are separated by a distance corresponding to the height of item 110*e*. Those skilled in the art will thus appreciate that longitudinal conversion element 410*f* and/or converting instrument 412*b* thereof can be accurately positioned at a location and separated from the side of item 110*e* by a distance corresponding to the height of item 110*e*.

In another embodiment the first beam 706*a* can be pointed downwards and intersect with (e.g., make a marking or visual indication on) the riser 320 or extension 321 (product shelf) rather than the packaging template. Thereby a more accurate marking can be achieved, since the frame components may be more vertically stable than the packaging template 112*b* (or sheet material 104 thereof), which may move up and down to the degree the guides and gap allows. Furthermore the marking can more easily be compared to markers (on the frame) for different sheet widths, thus indicating if a bale change is needed or appropriate.

Lighting element 702 can also be configured and/or calibrated to project a second beam 706*b* from measuring mechanism 700 (generally) longitudinally (and downward) toward packaging template 112*b*. Specifically, second beam 706*b* can intersect with packaging template 112*b* at a position and/or location that is separated from a converting instrument of transverse conversion element 440*c* (e.g., by a distance corresponding to (e.g., similar or equal to) the height of item 110*e*). Accordingly, second beam 706*b* can mark a location for advancing packing template 112*b* (or sheet material 104 thereof) during processing (e.g., in order to produce transverse conversion function(s) thereby).

In at least one embodiment, the transverse conversion function(s) produced thereby can be separated by a distance (e.g., corresponding to the height of item 110*e*). For instance, as illustrated in FIGS. 14A-14D, packaging template 112*b* can have a plurality of transverse conversions (e.g., cuts) extending from the outer side edge(s) 115 thereof (inwardly) to or toward longitudinal conversion(s) (e.g., crease(s)) 119. A first transverse conversion 105*a* can be separated from the front end 107 of packaging template 112*b* by a first distance 109*a*. As illustrated in FIGS. 14A-14D, first distance 109*a* can correspond to the vertical height 111 of item 110*e*. In alternative embodiments, first distance 109*a* can correspond to the longitudinal length 113 of item 110*e* or another measurement. In certain embodiments, first distance 109*a* can comprise a buffer distance (e.g., for use in the formation of a tear-away tab).

Similarly, a second transverse conversion 105*b* can be separated from first transverse conversion 105*a* by a second distance 109*b*. As illustrated in FIGS. 14A-14D, first distance 109*a* can correspond to the longitudinal length 113 of item 110*e*. In alternative embodiments, first distance 109*a* can correspond to the vertical height 111 of item 110*e* or another measurement. A third transverse conversion 105*b* can be separated from second transverse conversion 105*b* by first distance 109*a* (e.g., corresponding to vertical height 111 of item 110*e*) in some embodiments. Thus, transverse conversion element(s) 440*c* (and optionally 440*d*) and/or converting instrument(s) thereof can produce transverse conversion function(s) that are separated by a distance corresponding to the height of item 110*e*. Those skilled in the art will thus appreciate that transverse conversion element(s) 440*c* (and/or 440*d*) can be accurately deployed at locations and/or positions separated by a distance corresponding to the height of item 110*e*.

Figure 14A:
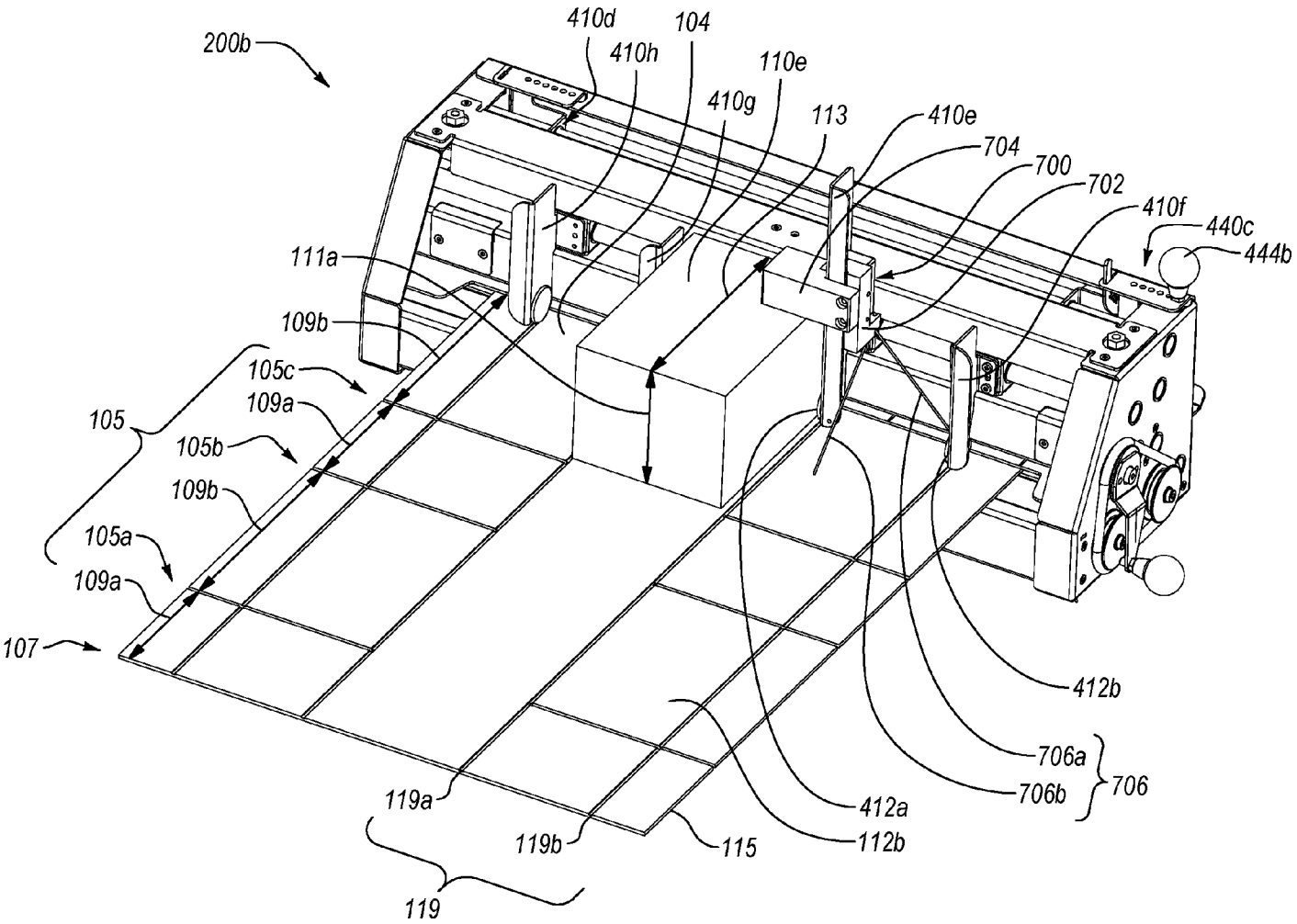
FIGS. 14A-14D illustrate perspective views of some components of the packaging system of FIG. 13 in various configurations.

The (actual) dimension(s) (e.g., longitudinal length) of item 110*e* can be used as a (direct) indication of an appropriate location and/or position to advance packaging template 112*b* or one or more transverse conversions thereof. For instance, as illustrated in FIG. 14A, transverse conversion 105*c* can be aligned with the end of item 110*e* (distal to transverse conversion element(s) 440*c*), thus positioning packaging template 112*b* and/or sheet material 104 in a location or position where a transverse conversion function performed thereon will form a transverse conversion 105*d* (see FIG. 14B) that is separate from transverse conversion 105*c* by a distance 109*b* corresponding to the longitudinal length 113 of item 110*e*.

Figure 14B:
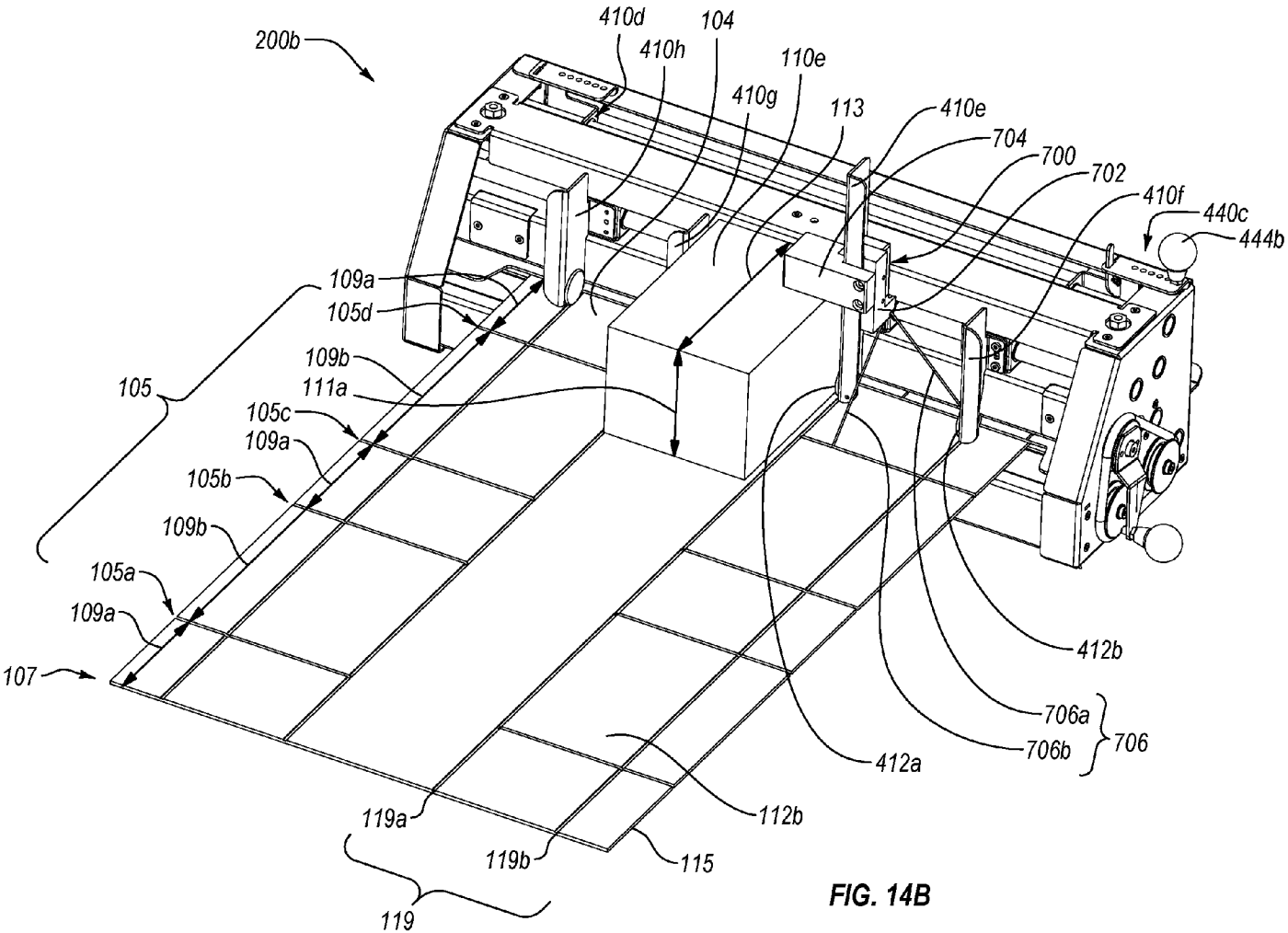

Furthermore, second beam 706*b* of measuring mechanism 700 can produce a visual indication of an appropriate position or location for advancing or feeding packaging template 112*b* or sheet material 104. For instance, as illustrated in FIG. 14B, transverse conversion 105*d* can be aligned with the visual indication of second beam 706*b*, thus positioning packaging template 112*b* and/or sheet material 104 in a location or position where a transverse conversion function performed thereon will form a transverse conversion (not shown) that is separate from transverse conversion 105*d* by a distance 109*a* corresponding to the vertical height 111 of item 110*e*. In at least one embodiment, the transverse conversion function can comprise cutting or severing entirely through the thickness and transverse width of sheet material 104 to release packaging template 112*b* therefrom.

Those skilled in the art will also appreciate that adjustment of the positioning of lighting element 702 can cause and/or result in a change in the position of beam(s) 706. For instance, as lighting element 702 is moved vertically upward (e.g., by repositioning measuring mechanism 700 along the vertical height of longitudinal conversion element 410*e*) the distance of separation between longitudinal conversion element 410*e* (and/or converting instrument 412*a* thereof) and the point at which beam(s) 706 intersect with packaging template 112*b* (or sheet material 104 thereof) can increase. For instance, marking element 704 can be repositioned atop an item 110 of any suitable height, causing the point of intersection between beam(s) 706 and packaging template 112*b* (or sheet material 104 thereof) to change accordingly. Thus, accurate marking of positions suitable for performing one or more conversion functions can be indicated and/or marked.

Figure 14C:
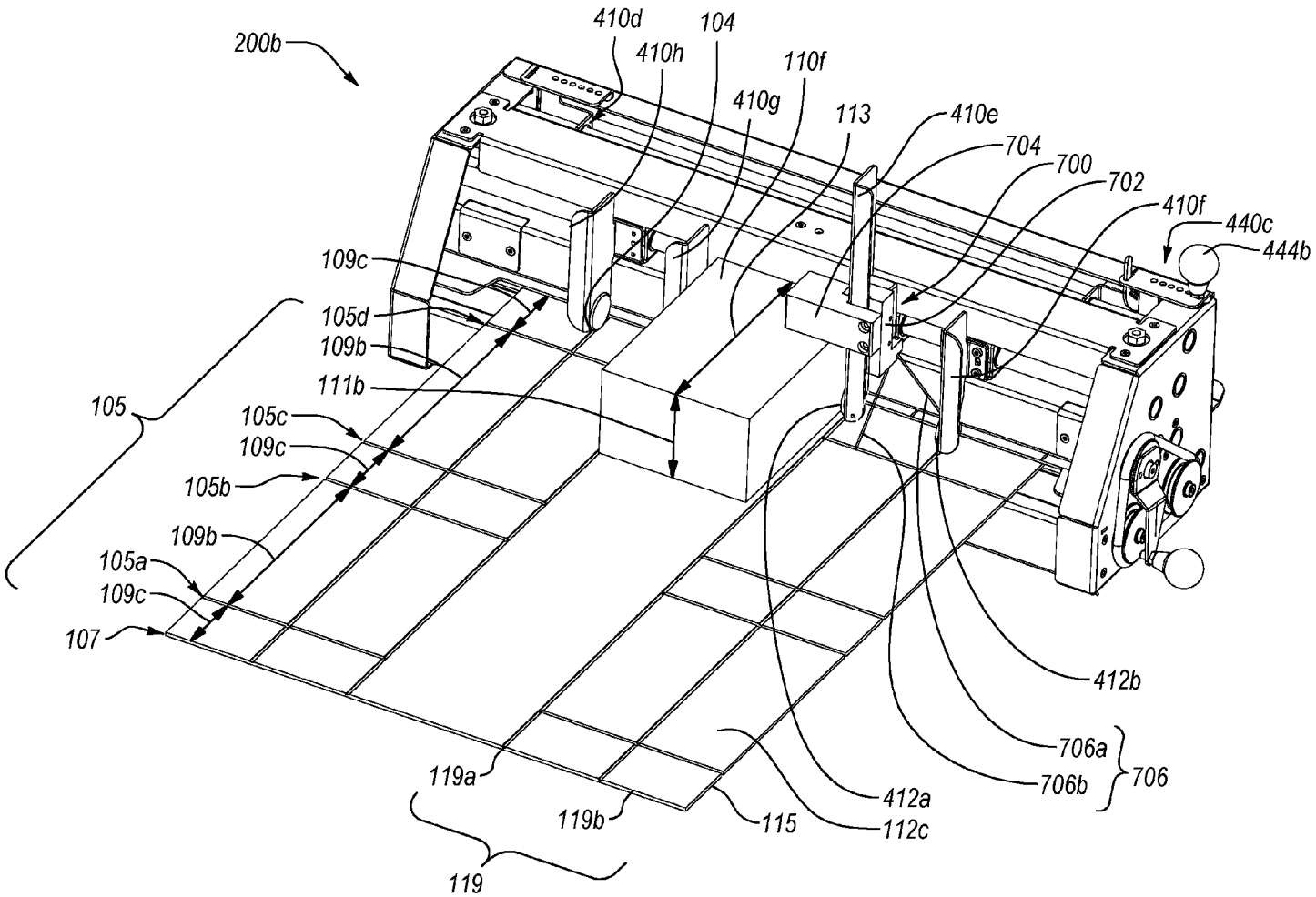

Similarly, as lighting element 702 is moved vertically downward (e.g., by repositioning measuring mechanism 700 along the vertical height of longitudinal conversion element 410*e*) the distance of separation between longitudinal conversion element 410*e* (and/or converting instrument 412*a* thereof) and the point at which beam(s) 706 intersect with packaging template 112*c* (or sheet material 104 thereof) and/or component(s) of converting machine 200*b* can decrease. For instance, as illustrated in FIG. 14C, marking element 704 can be repositioned atop an item 110*f* having a vertical height 111*b* that is less than vertical height 111*a* of item 110*e*. The repositioning of marking element 704 alters the position or location of the visual indication(s) produced by beam(s) 706. Longitudinal conversion elements 410*h* and 410*f* can be adjusted to correspond with the new position or location of the visual indication produced by beam 706*a*. Accordingly, the location of longitudinal conversion 119*b* on the transverse width of packaging template 112*c* is altered relative to packaging template 112*b*. In particular, longitudinal conversion 119*b* is closer to longitudinal conversion 119*a* in packaging template 112*c* than in packaging template 112*b*.

Similarly, because the new position or location of the visual indication produced by beam 706*b* corresponds to the height 111*b* of item 110*f*, the distance 109*c* between transverse conversions 105*b* and 105*c*, for example, can also correspond to the height 111*b* of item 110*f*. Because the longitudinal length 113 of item 110*f* is the same as the length of item 110*e*, the distance 109*b* between transverse conversions 105*a* and 105*b*, for example, can still correspond to the length 113 of item 110*f*.

Figure 14D:
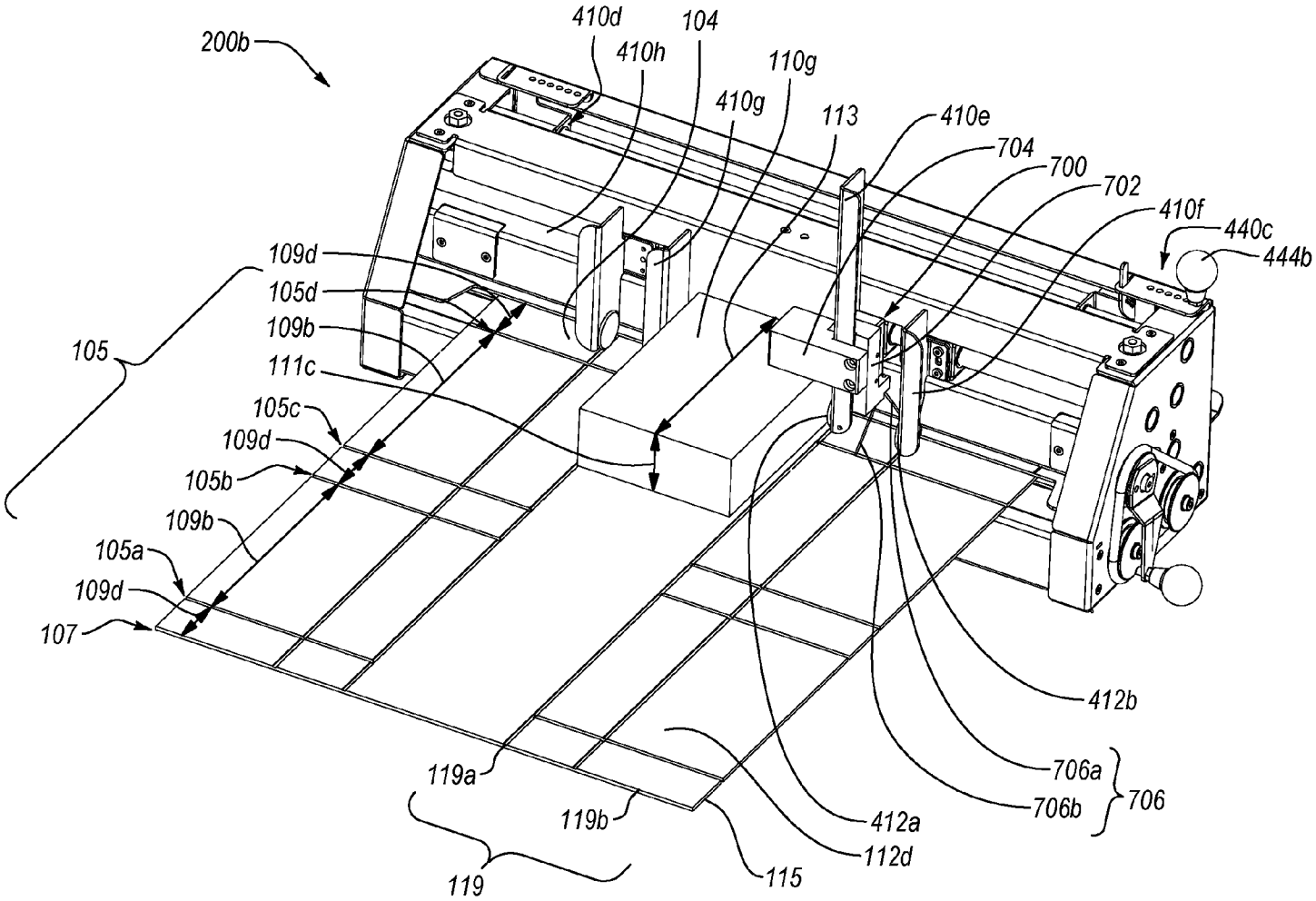

As illustrated in FIG. 14D, marking element 704 can be repositioned atop an item 110*g* having a vertical height 111*c* that is less than vertical height 111*b* of item 110*f*. The repositioning of marking element 704 alters the position or location of the visual indication(s) produced by beam(s) 706. Longitudinal conversion elements 410*h* and 410*f* can again be adjusted to correspond with the new position or location of the visual indication produced by beam 706*a*. Accordingly, the location of longitudinal conversion 119*b* on the transverse width of packaging template 112*c* is altered. In particular, longitudinal conversion 119*b* is closer to longitudinal conversion 119*a* in packaging template 112*d* than in packaging template 112*c*.

Similarly, because the new position or location of the visual indication produced by beam 706*b* corresponds to the height 111*c* of item 110*g*, the distance 109*d* between transverse conversions 105*b* and 105*c*, for example, can also correspond to the height 111*c* of item 110*g*. Because the longitudinal length 113 of item 110*g* is the same as the length of item 110*e* and item 110*f*, the distance 109*b* between transverse conversions 105*a* and 105*b*, for example, can still correspond to the length 113 of item 110*g*.

In one embodiment, the angle of or in which the beams 706 are directed downwards longitudinally and/or transversely towards the packing template (or riser extension), is about 45 degrees (relative to the vertical, for example, of longitudinal conversion element 410*e*). In at least one embodiment, a 45 degree angle can cause the transverse and/or longitudinal position of the beam intersection point to be adjust in accordance with the vertical position of lighting element 702. For instance, a defined vertical adjustment in the height of lighting element 702 can result in a corresponding (e.g., equal) transverse and/or longitudinal adjustment of the beam intersection point. Thus, an item that is 1 cm taller (than another item), can produce and/or result in that the markers from beams 706 being moved 1 cm further out.

Other embodiments can have one or more of the beams positioned or directed in another angle. For instance, an angle of about 27 degrees relative to vertical (or 63 degrees relative to horizontal) can result in a marker positioned essentially half the distance of the items' height. Accordingly, an additional height of 1 cm results in a new marker position only 0.5 cm further out. This would be suitable, for example, for making flaps that would meet in the middle (of the height). Depending on packaging design other angles can also be appropriate. At least one embodiment can have a plurality of beams indicating various, additional, or more angles (transversely and/or longitudinal), and possibly differentiated by colors. In should also be understood that the position of lighting element 702 on the marking element 704 may need to be adjusted depending on the distance between transverse converting instrument(s) 412*a* and inner longitudinal converting elements 412. Other factors that can affect the positioning of the lighting elements are the packaging designs and material thicknesses. This is due to the need of the previously mentioned "buffer space".

In at least one embodiment, the movement of longitudinal conversion element 410*f* can be coordinated with the movement of measuring mechanism 700. For instance, as indicated above, a user can (manually) position longitudinal conversion element 410*f* at a location that is separated from longitudinal conversion element 410*e* by a distance corresponding to the height of item 110*e* and/or the distance between marking element 704 and packaging template 112*b* (or sheet material 104 thereof). Alternatively (or in addition), a movement coordinating mechanism (such as a pulley system or other symmetrical movement assembly) can (automatically, mechanically, electrically, hydraulically, and/or pneumatically) adjust the transverse position of longitudinal conversion element 410*f* in response to a vertical repositioning of measuring mechanism 700 and/or marking element 704 thereof. In certain embodiments, second and/or third measuring mechanism 700 and/or marking element 704 thereof can also be repositioned thereby.

Thus, a user need not perform separate, intermediate measuring functions in some embodiments of the present disclosure. Instead, the item 110*e* (itself) can provide the measurement(s) and/or act as the measuring tool by providing outer dimensions suitable for positioning components of converting machine 200*b* about. Specifically, as discussed in further detail below, in at least one embodiment, longitudinal conversion elements 410*e* and 410*g* can be positioned about item 110*e* (on, about, and/or at positions corresponding to (opposing) sides thereof) and measuring mechanism 700 and/or marking element 704 thereof can be positioned atop item 110*e*. In response to such combination of positions about item 110*e*, longitudinal conversion elements 410*f* and 410*h* can be positioned at a distance from longitudinal conversion elements 410*e* and 410*g*, respectively and/or suitable position(s) for positioning longitudinal conversion elements 410*f* and 410*h* can be can be marked and/or indicated (e.g., by one or more (additional) measuring mechanisms 700 and/or marking elements 704 thereof). Suitable feed location(s) and/or position(s) for performing one or more transverse conversion functions can also be marked and/or indicated (e.g., by one or more (additional) measuring mechanisms 700 and/or marking elements 704 thereof) in response to such combination of position about item 110*e* in some embodiments.

Figure 15:
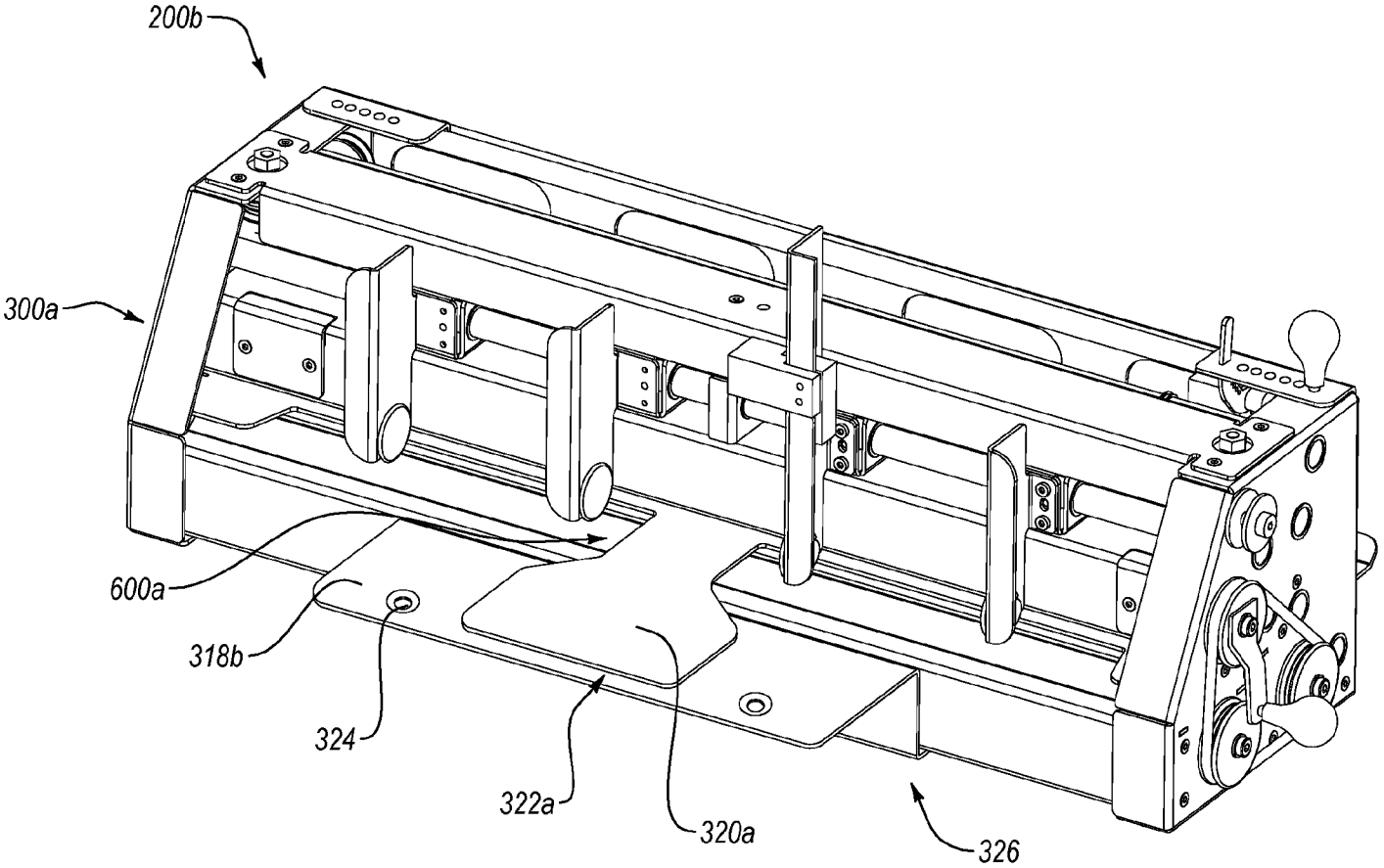
FIG. 15 illustrates a front perspective view of a converting machine useful in the packaging system of FIG. 13.

As illustrated in FIG. 15, converting machine 200*b* can comprise a receiving area 600*a* (e.g., disposed at the front thereof). Converting machine 200*b* can also include one or more risers 320*a*. Riser 320*a* can be elongated (relative to riser 320 of converting machine 200, for instance) and/or can be configured to receive an end portion of item 110*e* thereon (e.g., in order to lift the end portion above a pre-determined level). In particular, risers 320*a* can be separated from platform 318*b* by a gap, space, and/or distance 322*a*. Platform 318*b* can include one or more mounting elements (e.g., holes) for attaching converting machine 200*b* and/or platform 318*b* thereof to a support structure. Specifically, converting machine 200*b* can be attached to a support structure such that platform 318*b* contacts and/or lays (flat) on the surface of the support structure to which it is attached. Thus, the surface of the support structure can be and/or act as an extension of platform 318*b* in some embodiments, or even replace it. In addition, platform 318*b* can have a (lower) attachment member 326 configured to secure platform 318*b* to frame 300 of converting machine 200*b*. For instance, attachment member 326 can be connected to the bottom and/or underside of converting machine 200*b* in some embodiments.

II. Methods

In certain embodiments, the described systems and/or converting machines thereof can be implemented in one or more method and/or process embodiments of the present disclosure. One will appreciate, however, that one or more embodiments of the present disclosure can be accomplished and/or implemented without the described systems and/or converting machines thereof.

In at least one embodiment, a method of forming a packaging template includes providing a sheet material and performing one or more conversion functions on at least a portion of the sheet material. For instance, the method can include performing one or more longitudinal conversion functions on at least a portion of the sheet material, performing one or more transverse conversion functions on the sheet material at a first position, and/or performing one or more transverse conversion functions on the sheet material at a second position. In some embodiments, the sheet material is converted into the packaging template by performance of the one or more transverse conversion functions and the one or more longitudinal conversion functions. For instance, the one or more transverse conversion functions and/or the one or more longitudinal conversion functions can comprise creasing, bending, folding, perforating, cutting, and/or scoring the sheet material.

Another illustrative method can include placing one or more to-be-packaged items in a receiving area of a converting machine, adjusting one or more components of the converting machine according to at least one outer dimension of the one or more items, and converting sheet material into a packaging template configured for assembly into a box or packaging adapted for receiving the one or more items. Accordingly, the method can include feeding the sheet material into a converting machine.

Figure 16:
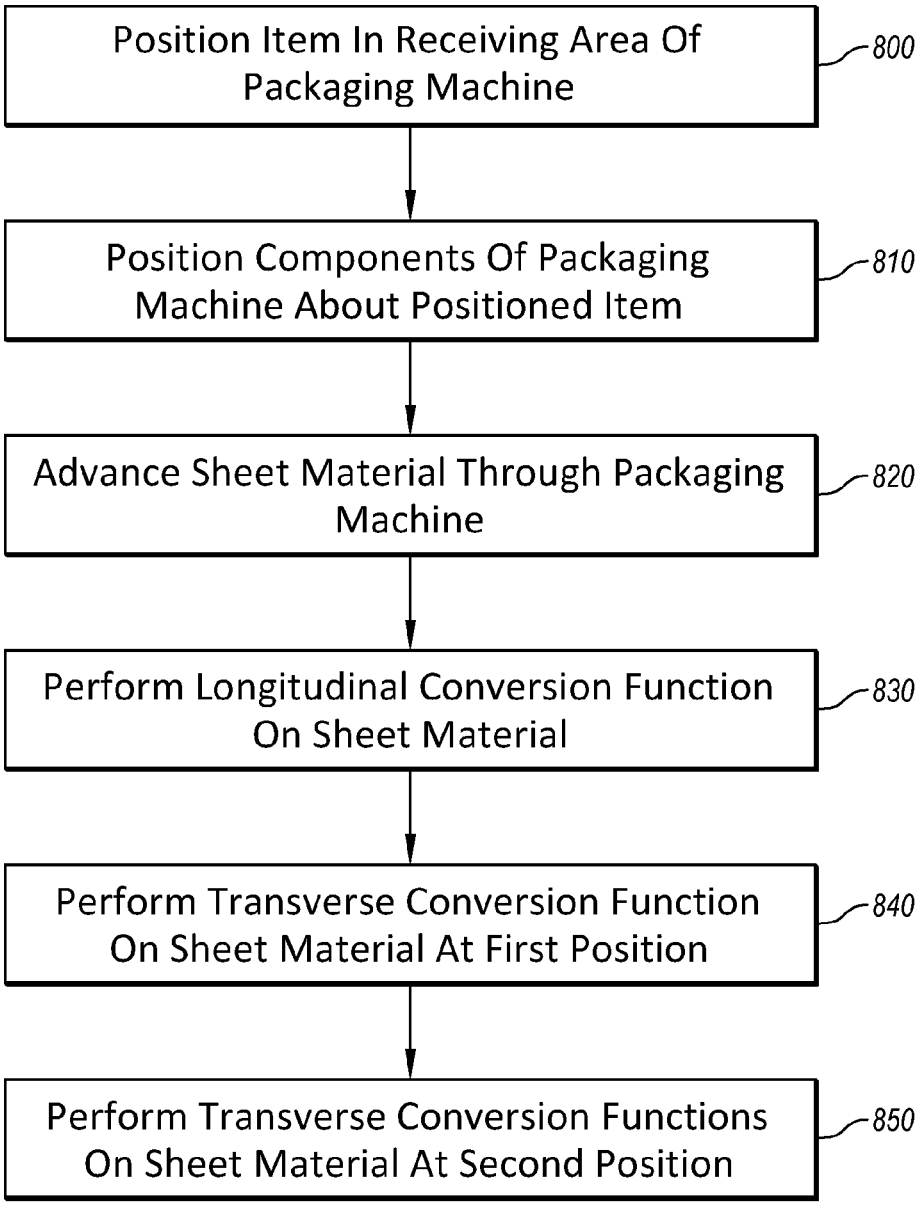
FIG. 16 is a flowchart a flowchart depicting an exemplary method of forming a packaging template in accordance with an embodiment of the present disclosure.

FIG. 16 is a flowchart depicting exemplary steps of an illustrative method of forming a packaging template (such as packaging template 112) according to an embodiment of the present disclosure. As illustrated in FIG. 16, the method can include a step 800 of placing an item in a receiving area of a packaging machine. The method can also include a step 810 of positioning one or more components of the packaging machine about the positioned item, a step 820 of advancing a sheet material through the packaging machine, a step 830 of performing one or more longitudinal conversion functions on at least a portion of the sheet material, a step 840 of performing one or more transverse conversion functions on the sheet material at a first position, and a step 850 of performing one or more transverse conversion functions on the sheet material at a second position. Those skilled in the art will appreciate that additional steps 820, 830, 840, and/or 850 can be performed to alter the specific design of the produced packaging template 112.

As discussed above, the converting machine can have a converting assembly configured for receiving and converting the sheet material into the packaging template, an advancing mechanism configured for advancing the sheet material through the converting assembly in a longitudinal direction, one or more transverse conversion elements configured for performing the one or more transverse conversion functions on the sheet material, one or more longitudinal conversion elements configured for performing the one or more longitudinal conversion functions on the sheet material, and/or one or more additional components as described herein.

The method can include advancing the sheet material through the converting assembly (a first longitudinal distance) to a first position. In addition, the one or more longitudinal conversion functions are performed on the sheet material while the sheet material is advanced through the converting assembly and at least one of the one or more transverse conversion functions are performed on the sheet material at the first position. The method can also include advancing the sheet material through the converting assembly from the first position to a second position and/or performing one or more transverse conversion functions on the sheet material at the second position.

The method can further include placing the one or more to-be-packaged items in the receiving portion of the converting machine, selectively positioning a first longhead of the at least one pair of longheads at a position corresponding to a first side of the one or more to-be-packaged items, and/or selectively positioning a second longhead of the at least one pair of longheads at a position corresponding to a second side of the one or more to-be-packaged items opposite the first side. As discussed above, the first and second longheads can perform the one or more longitudinal conversion functions on the sheet material while the sheet material is advanced through the converting assembly. In addition, the second longhead is selectively positioned in response to selectively positioning the first longhead by means of the symmetrical movement assembly connected to the first and second longheads. Those skilled in the art will appreciate that advancing the sheet material through the converting assembly from the first position to the second position can comprise advancing the sheet material a second longitudinal distance, the second longitudinal distance corresponding to a dimension (e.g. height or length) of the one or more to-be-packaged items.

The method can also include selectively positioning a third longhead a first transverse distance from the positioned first longhead on the first side of the one or more to-be-packaged items and along the width of the converting machine and/or selectively positioning a fourth longhead a second transverse distance from the positioned second longhead on the second side of the one or more to-be-packaged items and along the width of the converting machine (e.g., opposite the third longhead). In at least one embodiment, the fourth longhead can be selectively positioned in response to selectively positioning the third longhead by means of the symmetrical movement assembly connected to the third and fourth longheads. In some embodiments, the first transverse distance can be substantially the same as the second transverse distance. In other words, the symmetrical movement assembly can cause the equal and opposite movement of the fourth longhead in response to selectively moving the third longhead.

In some embodiments, the first transverse distance and/or second transverse distance corresponds to the height of the one or more to-be-packaged items. Moreover, advancing the sheet material through the converting assembly to the first position can comprise advancing the sheet material a first longitudinal distance, the first longitudinal distance corresponding to the first transverse distance and/or second transverse distance.

The method can also include advancing the sheet material through the converting assembly from the second position to a third position and/or performing one or more transverse conversion functions on the sheet material at the third position. In some embodiments, advancing the sheet material through the converting assembly from the second position to a third position can comprise advancing the sheet material a third longitudinal distance, the third longitudinal distance corresponding to the first transverse distance and/or second transverse distance. In one embodiment, performing one or more transverse conversion functions on the sheet material at the third position can comprise cutting through the sheet material, thereby separating the packaging template from a remainder of the sheet material. However, in other embodiments, performing one or more transverse conversion functions on the sheet material at the third position can comprise cutting partially through the sheet material (e.g., up to but not past the first and second longitudinal conversion elements), thereby retaining a connection between the packaging template and the remainder of the sheet material.

The method can also include advancing the sheet material through the converting assembly from the third position to a fourth position and/or performing one or more transverse conversion functions on the sheet material at the fourth position. In some embodiments, advancing the sheet material through the converting assembly from the third position to the fourth position can comprise advancing the sheet material a fourth longitudinal distance, the fourth longitudinal distance corresponding to the length of the one or more to-be-packaged items. In one embodiment, performing one or more transverse conversion functions on the sheet material at the fourth position can comprise cutting through the sheet material, thereby separating the packaging template from a remainder of the sheet material. However, in other embodiments, performing one or more transverse conversion functions on the sheet material at the fourth position can comprise cutting partially through the sheet material (e.g., up to but not past the first and second longitudinal conversion elements), thereby retaining a connection between the packaging template and the remainder of the sheet material.

The method can also include advancing the sheet material through the converting assembly from the fourth position to a fifth position and/or performing one or more transverse conversion functions on the sheet material at the fifth position. In some embodiments, advancing the sheet material through the converting assembly from the fourth position to a fifth position can comprise advancing the sheet material a fifth longitudinal distance, the fifth longitudinal distance corresponding to at least one of the first transverse distance and second transverse distance. Furthermore, performing one or more transverse conversion functions on the sheet material at the fifth position can comprise cutting through the sheet material, thereby separating the packaging template from a remainder of the sheet material.

An exemplary method is directed to converting sheet material into a packaging template for assembly into a box or other packaging material configured to receive one or more to-be-packaged items. The one or more to-be-packaged items have a plurality of outer dimensions including a height, a width, and a length. The method can include: (1) placing the one or more to-be-packaged items in a receiving portion of a converting machine, (2) measuring at least one dimension of the one or more to-be-packaged items in the receiving portion. Measuring the at least one dimension can include (a) selectively positioning a first of a set of longitudinal conversion elements at a position corresponding to a first side of the one or more to-be-packaged items and/or selectively positioning a second of the set of longitudinal conversion elements at a position corresponding to a second side of the one or more to-be-packaged items opposite the first side. The method may also include (3) advancing the sheet material through the converting assembly to a first position; (4) performing one or more longitudinal conversion functions on at least one portion of the sheet material with the set of longitudinal conversion elements while advancing the sheet material through the converting assembly; (5) performing one or more transverse conversion functions on the sheet material at the first position with the set of transverse conversion elements; (6) advancing the sheet material through the converting assembly from the first position to a second position; and/or (7) performing one or more transverse conversion functions on the sheet material at the second position with the set of transverse conversion elements, etc.

Another method of forming a packaging template for assembly into a box or other packaging material can include: (1) feeding a supply of fanfold sheet material into a converting machine; (2) placing the one or more to-be-packaged items in the receiving portion; (3) measuring at least the width of the one or more to-be-packaged items in the receiving portion. Measuring the width may comprise selectively positioning the means for performing one or more longitudinal conversion functions about the one or more to-be-packaged items or at a position corresponding to opposing first and second sides of the one or more to-be-packaged items. The method may also include (4) advancing the sheet material through the converting assembly to a first position; (5) performing one or more longitudinal conversion functions on at least a portion of the sheet material with the means for performing one or more longitudinal conversion functions while advancing the sheet material through the converting assembly to the first position; (6) performing one or more transverse conversion functions on the sheet material at the first position with the means for performing one or more transverse conversion functions; (7) advancing the sheet material through the converting assembly from the first position to a second position; (8) performing one or more longitudinal conversion functions on at least a portion of the sheet material with the means for performing one or more longitudinal conversion functions while advancing the sheet material through the converting assembly from the first position to a second position; and/or (9) performing one or more transverse conversion functions on the sheet material at the second position with the means for performing one or more transverse conversion functions.

In some embodiments, (each of) the one or more transverse conversion functions and/or (each of) the one or more longitudinal conversion functions can be selected from the group consisting of creasing, bending, folding, perforating, cutting, and scoring. The means for performing one or more longitudinal conversion functions can comprise a plurality of longheads each having one or more converting instruments for performing the one or more longitudinal conversion functions on the sheet material, the plurality of longheads being adapted to be selectively repositionable along the width of the converting assembly to permit the one or more longitudinal conversion functions to be performed at different positions along the width of the sheet material.

Furthermore, at least one of the one or more converting instruments of at least one of the one or more longheads can be selected from the group consisting of a creasing element, a bending element, a folding element, a perforating element, and a scoring element such that at least one of the one or more longitudinal conversion functions comprises altering a configuration of a first portion of the sheet material without cutting entirely through the first portion. Alternatively (or in addition), at least one of the one or more converting instruments of at least one of the one or more longheads can be selected from the group consisting of a cutting element, a blade, a knife, and a razor such that at least one of the one or more longitudinal conversion functions comprises altering a configuration of a first portion of the sheet material by cutting entirely through the first portion.

Similarly, the means for performing one or more transverse conversion functions can comprise a plurality of crossheads each having one or more converting instruments for performing the one or more transverse conversion functions on the sheet material, the plurality of crossheads being selectively movable relative to the sheet material and along at least a portion of the width of the converting assembly in order to perform the one or more transverse conversion functions on the sheet material. Accordingly, performing one or more transverse conversion functions on the sheet material can comprise advancing the plurality of crossheads along at least a portion of the width of the converting assembly. Advancing the plurality of crossheads can include moving the plurality of crossheads from an outer position to an inner position, the inner position corresponding to the position of the means for performing one or more longitudinal conversion functions after selectively positioning the same. Alternatively (or in addition), advancing the plurality of crossheads comprises moving one or more of the plurality of crossheads transversely across an entire width of the sheet material.

The method can also include retracting the one or more crossheads along at least a portion of the width. At least one of the one or more converting instruments of at least one of the plurality of crossheads can be selected from the group consisting of a cutting element, a blade, a knife, and a razor such that at least one of the one or more transverse conversion functions comprises altering a configuration of a second portion of the sheet material by cutting entirely through the second portion. Alternatively (or in addition), at least one of the one or more converting instruments of at least one of the plurality of crossheads can be selected from the group consisting of a creasing element, a bending element, a folding element, a perforating element, and a scoring element such that at least one of the one or more transverse conversion functions comprises altering a configuration of a second portion of the sheet material without cutting entirely through the second portion.

In some embodiments, one or more of the feeding step, the advancing steps, the performing one or more longitudinal conversion functions steps, and the performing one or more transverse conversion functions steps are conducted manually by a user. In certain embodiments, the feeding step, the advancing steps, the performing one or more longitudinal conversion functions step, and the performing one or more transverse conversion functions step are all conducted manually by a user.

In some embodiments, one or more of the feeding step, the advancing steps, the performing one or more longitudinal conversion functions steps, and the performing one or more transverse conversion functions steps are conducted electronically by a user initiating the one or more steps. Alternatively (or in addition), one or more of the feeding step, the advancing steps, the performing one or more longitudinal conversion functions steps, and the performing one or more transverse conversion functions steps can be conducted automatically after an initiation step.

The method can also include selecting a sheet material having a width greater than the width of the one or more to-be-packaged items and/or selecting a sheet material having dimensions suitable for forming a packaging template for assembly into a box or other packaging material with dimensions suitable for receiving the one or more to-be-packaged items therein. In certain embodiments, the sheet material is fed underneath at least a portion of the receiving area.

Another method of forming a packaging template from a sheet material can include securing one or more longitudinal conversion elements about opposing sides of one or more items to be packaged, performing one or more longitudinal conversion functions on the sheet material at a first location, and/or performing one or more transverse conversion functions on the sheet material at a second location. In some embodiments, one or more outer dimensions of the one or more items can be used to determine the first and second location.

Another method of converting a sheet material into a packaging template for assembly into a box or other packaging material can include: (1) placing one or more to-be-packaged items in a receiving area of a converting machine, the one or more items comprising a plurality of outer dimensions including a height, a length, and a width disposed between a first outer side wall and an opposing second outer side wall; (2) positioning means for performing one or more longitudinal conversion functions adjacent to the first and second outer side walls; (3) feeding the sheet material through the converting machine; (4) performing one or more longitudinal conversion functions on the sheet material at a first location with the means for performing one or more longitudinal conversion functions; and/or (5) performing one or more transverse conversion functions on the sheet material at a second location with the means for performing one or more transverse conversion functions. In at least one embodiment, one or more of the plurality of outer dimensions is used to determine the first and second location.

Various embodiment of the present disclosure relate to systems, methods, and apparatus for forming custom packaging templates adapted for assembly into a box or other shipping container. Certain illustrative methods can be implemented using a converting machine as described herein. A reference item can be selected for which the custom-designed packaging template is desired. A fan-folded bale of cardboard suitable for creating the template can be selected. Selecting can include choosing a cardboard supply having a suitable thickness and width given the size of the item. However, exact measurement of the dimensions of the item may not be required. A user may simply estimate a suitable cardboard size depending on the general size and shape of the item. The width of the cardboard may, however, need to be greater than the width of the item in certain embodiments. Suitable selection criteria will be apparent to those skilled in the art and/or may be learned by the practice of exemplary embodiments of the present disclosure.

At least one embodiment can include a measuring mechanism or marking element (e.g., for the outer longheads) to select appropriate material width. Comparing the mark or position with a ruler and/or markers for each available width can make the selection of material easier and/or more accurate. Those skilled in the art will also appreciate, in light of this disclosure, that the dimensions of the item to be packaged, as well as the packaging design to be used in forming a packaging template, will often determine the minimal and maximal width that can or should be used (e.g., within the range of widths compatible with the converting machine and/or converting assembly thereof.

The user can then place the item in a receiving area in the front of the converting machine and feed the fanfold cardboard into the back thereof. The cardboard can be fed into the machine by means of a feed assembly having a plurality of rollers connected to a crank. Rotational movement of the crank in a first direction can cause rotational movement of the rollers in the same (or opposite) direction. Rotational movement of the crank in the opposite direction can cause opposite rotational movement of the rollers. Thus, the cardboard can be fed into the machine by rotating the crank while inserting the cardboard to the rollers.

Rear guides and/or rear rollers can be used to ensure proper alignment of the cardboard as it enters the machine and/or to enhance the longitudinal movement of the cardboard into the machine. In particular, transverse shifting of the cardboard as it advances longitudinally through the machine can be undesirable in some embodiments. One or more internal components of the machine can also ensure proper alignment of the cardboard.

The user can also adjust one or more settings of the machine prior to processing the cardboard. For instance, with the item in the receiving area, the user can slide first and second, opposing, longheads from an outer position to an inner position corresponding to the sides of the item. This positioning of the longheads can essentially measure the item while simultaneously configuring the machine for creating a custom template for the item. The longheads can be configured to crease the cardboard (e.g., to form a longitudinal crease) at or near the position corresponding to the sides of the item as the cardboard is cranked through the machine. Such a crease can enable folding of the custom template to form the box. The longheads can also be connected to a pulley system that induces symmetrically, equal and opposite movement of the two longheads. For instance, the longheads can be connected to opposite sides of a transverse pulley line running through one or more pulley wheels. Alternatively, the longheads can move independently in some embodiments.

Optionally, the machine can include a second set of longheads (i.e., outer longheads), which can also form one or more longitudinal creases (or make longitudinal cuts) at one or more positions along the transverse width of the machine. In at least one embodiment, the user can position the outer longheads at a predetermined outer position. The outer position can be separated from the inner longheads by a distance greater than, less than, equal to, and/or corresponding to the height of the item. The outer longheads can be configured to trim any peripheral cardboard by cutting the cardboard longitudinally during processing. Alternatively, the outer longheads can form longitudinal creases in the cardboard whereby the template can be folded over to reinforce the container. In at least one embodiment, the outer longheads can be moved to an outer-most position such that the outer longheads do not contact, crease, and/or cut the cardboard (e.g., during processing).

The outer longheads can also be symmetrically connected and/or connected to a positioning element. The positioning element can, for instance, automatically position the outer longheads when the user positions a positioning member atop the item (e.g., at a position corresponding to the height and/or upper wall thereof. Such a mechanism can also produce a longitudinal reference point corresponding to the height of the item, the position of the positioning member, and/or the distance between the inner and outer longheads.

The user can then perform a first feed to advance the cardboard to a first position. The first position can correspond to the height of the item, the position of the positioning member, and/or the distance between the inner and outer longheads in some embodiments. The user can then perform a first transverse cut at the first position. Transverse cuts can be effectuated by means of a set (e.g., pair) of crossheads. A single crosshead embodiment is also contemplated herein. The crossheads can each have an upper handle (ease of user operation) and/or a lower cutting blade (or wheel) configured to sever through the portion of the cardboard to which it is exposed. The crossheads can be positioned in an outer, resting configuration while the cardboard is advanced through the machine. The user can then advance the crossheads inward to (but not beyond) the inner (or outer) longheads. Thus, the transverse cut can sever or slice the cardboard transversely from the outer side edges to an inner position (e.g., corresponding to the position of the inner longheads). Illustratively, these cuts can form flaps in the template that can be arranged as a top or bottom or side walls of the box. Movement of the crossheads can also be coordinated by a symmetrical pulley system.

One or more of the crossheads can be blocked (e.g., inhibited, (substantially) prevented, etc.) from advancing past the (inner) longheads. For instance, one or more of the longheads can have a stopper connected thereto and/or protruding therefrom. This stopper can catch the first crosshead at the appropriate transverse position. Furthermore, because the crossheads are symmetrically coordinated by the pulley system, both crossheads can be stopped at appropriate transverse position(s). However, upon selective detachment from the pulley system, the second crosshead can move independent of the first and thereby cut across the entire width of the cardboard. Cutting across the entire cardboard can separate the finished template from the feed supply.

Prior to severing the finished template, the user can perform a second feed to advance the cardboard from the first position to a second position. The (distance between the first position and the) second position can correspond to the length of the item in some embodiments. The user can then perform a second transverse cut at the second position. The second cut can sever the cardboard from the outer edges to the longheads or separate the template entirely from the feed supply. Whether the feeding is done manually or automatically, the item placed in the receiving area can directly serve as an indication of the feeding distance corresponding to the length of the item. With the proximal end of the item being in close proximity to the crossheads, now the distal end shows the position to which a previous transverse conversion mark (e.g., cut, crease, etc.) can or should be advanced in order to perform a subsequent transverse conversion function at an appropriate location (e.g., a position on the sheet material that is separated from the previous transverse conversion function by a distance corresponding to the length of the item).

The user can continue to perform feeds and cuts as necessary to produce the template(s) necessary to assemble the container. In at least one embodiment, the template can comprise a plurality of templates configured to be arranged and/or assembled together about the item. In other embodiments, the template comprises a unitary custom template configured to be arranged and/or assembled into a single, three-dimensional, self-container, self-securing, and/or closeable box or other container. To this end, the user can perform a third feed to advance the cardboard from the second position to a third position. The (distance between the second position and the) third position can (again) correspond to the height of the item, the position of the positioning member, and/or the distance between the inner and outer longheads in some embodiments. The user can then perform a third transverse cut at the third position.

The user can perform a fourth feed to advance the cardboard from the third position to a fourth position. The (distance between the third position and the) fourth position can (again) correspond to the length of the item in some embodiments. The user can then perform a fourth transverse cut at the fourth position.

The user can perform a fifth feed to advance the cardboard from the fourth position to a fifth position. The (distance between the fourth position and the) fifth position can (again) correspond to the height of the item, the position of the positioning member, and/or the distance between the inner and outer longheads in some embodiments. The user can then perform a fifth transverse cut at the fifth position. In certain embodiments, the fifth cut can separate the template entirely from the feed supply by advancing at least one of the crossheads (transversely) entirely across the cardboard. One will appreciate, however, that any of the aforementioned or additional cuts can sever the cardboard from the outer edges to the longheads or separate the template entirely from the feed supply. Thus, the user can design the template(s) for assembly into the container.

One or more of the foregoing can be performed manually by the user. Therefore, in at least one embodiment, the method can comprise a manual conversion process (e.g., that does not require the use of electricity or pneumatics). In such embodiments, performing feed and/or cuts can require physical exertion (e.g., instead of automated response). In other embodiments, however, one or more of the foregoing can be performed electrically and/or pneumatically.

As indicated above, the converting machine can also be disposed on or about the support structure such that the longitudinal outlet path of the packaging template (and/or platform) can be planar with and/or correspond to the surface of the support structure (e.g., table). Accordingly, certain methods can include using the table top as an extension of the platform. In addition, the user can stand to the side of the converting machine, adjacent to the longitudinal edge of the table. In this way, the user can be positioned out of the way of the packaging template as it is produced from the converting machine.

In at least one embodiment, the user can advance the sheet material into and/or through the converting machine and/or conversion assembly thereof by turning, cranking, and/or otherwise operating the advancing mechanism. The user can also (or alternatively) operate the advancing mechanism in reverse to retract the sheet material and/or packaging template back into the converting machine and/or conversion assembly thereof. Thus, the user can repeat and/or redo one or more method steps or perform one or more previously unperformed method steps.

The user can also use a suspension system to hoist, lift, and/or elevate the item (e.g., above the surface of the support structure) such that the sheet material and/or packaging template can more easily advance, slide, and/or move (e.g., longitudinally beneath the item). In one embodiment, the suspension system can be configured to lift the end of the item opposite the converting machine and/or the one or more risers can lift the end of the item adjacent to the converting machine and/or the receiving area thereof.

The user can also position opposing inner longheads about the item. For instance, the user can slide a first longhead against a first side of the item. In response, second longhead can be positioned against a second opposing side of the item. For instance, a symmetrical movement assembly can cause, create, and/or perform a corresponding, equal and opposite sliding motion of the second longhead. The second longhead can also be positioned manually by the user.

In some embodiment, the user can then measure the height of the item by operating a measuring mechanism. For instance, in at least one embodiment, the user can position at least one marking element atop the item. In response, one or more outer longheads (e.g., opposing outer longheads) can be positioned in a transverse location along the conversion assembly. For instance, the first and second outer longheads can be positioned about first and second inner longheads opposite and/or distal to the item. Specifically, the outer longheads can be separated from the inner longheads by a distance corresponding to the height of the item. For instance, the outer longheads can be connected to the measuring mechanism (e.g., mechanically, electrically, hydraulically, pneumatically, etc.) such that when the user moves the measuring mechanism (vertically up or down), a corresponding transverse movement of the outer longheads occurs automatically.

In other embodiments, the positioned measuring mechanism can cause, create, and/or perform a marking function. For instance, positioning of the measuring mechanism can cause an (automatic) positioning of one or more additional measuring mechanisms. In at least one embodiment, a marking element can be extended from and/or retracted towards the conversion assembly in response to positioning of the one or more measuring mechanisms. Thus, the position of the extended and/or retracted marking element can correspond to the position of the measuring mechanism. For instance, the marking element can be positioned a distance from the transverse conversion element(s) and/or converting instrument(s) thereof corresponding to the height of the item.

In other embodiments, the measuring mechanism(s) can comprise a lighting element (e.g., laser) that produces one or more beams. The beams can intersect with the sheet material and/or template at a transverse and/or longitudinal position corresponding to the vertical height of the item and/or measuring mechanism. Accordingly, the beam can mark a suitable position for adjusting the outer longhead(s) and/or advancing the sheet material (e.g., before performing one or more transverse conversion functions). For instance, the positioned measuring mechanism (atop the item) can cast a beam longitudinally forward and downward to the template. The mark of the beam on the template can indicate a position to which a previous transverse conversion mark (e.g., cut, crease, etc.) can be advanced in order to perform a subsequent transverse conversion function at an appropriate location (e.g., a position on the sheet material that is separated from the previous transverse conversion function by a distance corresponding to the height of the item and/or position of the measuring mechanism).

The positioned measuring mechanism (atop the item) can also (or alternatively) cast a beam transversely sideways and downward to the template. The mark of the beam on the template and/or a frame or other element (as described above), can indicate a position to which outer longheads can be positioned in order to perform a longitudinal conversion function and/or produce a longitudinal conversion mark at an appropriate location (e.g., a position on the sheet material that is separated from the inner longheads by a distance corresponding to the height of the item and/or position of the measuring mechanism). As indicated above, the beam can extend from the measuring mechanism at a 45 degree angle, a 63 degree angle, or other angle relative to horizontal (or a corresponding angle (e.g., 27 degrees) relative to vertical). In at least one embodiment, the converting machine can include one or more sensors configured to detect the beam. In response to the detected signal, the converting machine can automatically position the outer longheads, advance the sheet material, perform one or more longitudinal conversion function, and/or other steps of one or more methods described herein. Alternatively, all steps (including manually position the longheads and advancing the sheet material to position(s) corresponding to the height of the item) can be performed manually by the user.

While various aspects and embodiments have been disclosed herein, including examples thereof, other aspects and embodiments are contemplated. The various aspects and embodiments disclosed herein are for purposes of illustration and are not intended to be limiting. It is noted that products, processes, compositions, kits, and methods according to certain embodiments of the present invention may include, incorporate, or otherwise comprise properties, features, components, members, and/or elements described in other embodiments described and/or disclosed herein. Thus, reference to a specific feature in relation to one embodiment should not be construed as being limited to applications only within said embodiment. In addition, various embodiments can be combined to form additional embodiments without departing from the scope of the invention or this disclosure.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. While certain embodiments and details have been included herein and in the attached invention disclosure for purposes of illustrating the invention, it will be apparent to those skilled in the art that various changes in the products, processes, compositions, kits, and methods disclosed herein may be made without departing from the scope of the invention, which is defined in the appended claims. All changes which come within the meaning and range of equivalency of the claims are to be embraced within their scope. Various modifications that fall within the scope of the appended claims will be apparent to one skilled in the art.

I claim:

1. A converting machine for forming a packaging template, comprising:

a receiving area configured to receive one or more to-be-packaged items, the one or more to-be-packaged items having a plurality of outer dimensions including a height, a length, and a width disposed between a first outer side wall and an opposing second outer side wall;

a converting assembly comprising first and second longitudinal conversion elements, the converting assembly being aligned with the receiving area such that the first and second longitudinal conversion elements can be selectively positioned respectively adjacent to first and second outer side walls of the one or more to-be-packaged items; and means for advancing a sheet material past the first and second longitudinal conversion elements such that one or more longitudinal conversion functions are performed on the sheet material by the first and second longitudinal conversion elements as the sheet material is advanced past the first and second longitudinal conversion elements.

2. The converting machine of claim 1, wherein the converting assembly further comprises first and second transverse conversion elements selectively moveable about at least a portion of a transverse width of the converting assembly.

3. The converting machine of claim 2, further comprising at least one retention mechanism configured to prevent the first and/or second transverse conversion elements from advancing past the first and/or second longitudinal conversion elements.

4. The converting machine of claim 1, wherein one or more of the first and second longitudinal conversion elements and the means for advancing a sheet material are manually operable.

5. The converting machine of claim 1, wherein one or more of the first and second longitudinal conversion elements and the means for advancing a sheet material are electrically operable.

6. The converting machine of claim 1, further comprising a height indicator adapted to provide a visual indication on the sheet material of the height of the one or more to-be-packaged items.

7. The converting machine of claim 6, wherein the height indicator is moveably connected to the first and/or second longitudinal conversion elements.

8. The converting machine of claim 6, wherein the height indicator comprises a light source and the visual indication comprises a beam of light.

9. The converting machine of claim 8, wherein the beam of light is projected from the light source at an angle of either 27 degrees or 45 degrees, relative to vertical.

10. The converting machine of claim 1, further comprising a visual indicator adapted to provide a visual indication of an appropriate position for a third longitudinal conversion element, the appropriate position of the third longitudinal conversion element being related to at least one of the height, length, or width of the one or more to-be-packaged items.

11. A converting machine for forming a packaging template, comprising:

a converting assembly configured for receiving a sheet material and converting the sheet material into the packaging template, the converting assembly having:

a first side, a second side, and a transverse width therebetween; and a first end, a second end, and a longitudinal length therebetween;

at least one set of transverse conversion elements comprising a first transverse conversion element and a second transverse conversion element, selectively moveable along at least a portion of the transverse width, and configured for performing one or more transverse conversion functions on the sheet material;

at least one set of longitudinal conversion elements comprising a first longitudinal conversion element and a second longitudinal conversion element, selectively moveable along at least a portion of the transverse width, and configured for performing one or more longitudinal conversion functions on the sheet material as the sheet material is advanced through the converting assembly; and one or more symmetrical movement assemblies connected to the at least one set of longitudinal conversion elements and/or the at least one set of transverse conversion elements and configured to coordinate simultaneous and symmetrical movement of the first and second longitudinal conversion elements and/or the first and second transverse conversion elements about the at least a portion of the transverse width, wherein the simultaneous and symmetrical movement of the first and second longitudinal conversion elements or the first and second transverse conversion elements is substantially equal in length and opposite in direction.

12. The converting machine of claim 11, further comprising one or more of:

a sheet material inlet opening disposed at the first end of the converting machine configured for receiving the sheet material;

a packaging template outlet disposed at the second end of the converting machine configured for releasing the packaging template;

an in-feed guide configured to direct the sheet material into the converting assembly; and an out-feed guide configured to direct the packaging templates out of the converting assembly;

a receiving area disposed at the second end of the converting machine adjacent to the packaging template outlet, the receiving portion being configured for receiving one or more to-be-packaged items, the one or more to-be-packaged items having a plurality of outer dimensions including a height, a width, and a length; or an advancing mechanism connected to the converting assembly and configured for advancing the sheet material through the converting assembly in a longitudinal direction.

13. The converting machine of claim 12, wherein at least a portion of the receiving area is disposed less than 2.54 cm from the portion of the transverse width along which the one or more transverse conversion elements are moveable.

14. The converting machine of claim 11, wherein the one or more transverse conversion elements comprises at least one pair of crossheads and the one or more longitudinal conversion elements comprises at least one pair of longheads.

15. The converting machine of claim 14, wherein one or more of:

a symmetrical movement assembly of the one or more symmetrical movement assemblies is connected to the at least one pair of crossheads such that movement of a first crosshead of the at least one pair of crossheads causes an equal and opposite movement of a second crosshead of the at least one pair of crossheads; or a symmetrical movement assembly of the one or more symmetrical movement assemblies is connected to the at least one pair of longheads such that movement of a first longhead of the at least one pair of longheads causes an equal and opposite movement of a second longhead of the at least one pair of longheads.

16. The converting machine of claim 15, further comprising a crosshead release mechanism configured to disengage at least the first crosshead from the symmetrical movement assembly such that at least the first crosshead is permitted to move along at least a portion of the transverse width without causing movement of the second crosshead.

17. The converting machine of claim 16, further comprising a crosshead retention mechanism connected to at least one of the first and second longheads and configured to prevent at least one crosshead from advancing along the transverse width past the crosshead retention mechanism.

18. The converting machine of claim 11, further comprising a frame configured to structurally support the converting assembly, the frame comprising opposing vertical frame elements having a plurality of horizontal frame elements extending therebetween.

19. The converting machine of claim 18, wherein the first and second transverse conversion elements and the first and second longitudinal conversion elements are each connected to at least one of the plurality of horizontal frame elements, thereby being selectively moveable along at least a portion of the transverse width.

20. The converting machine of claim 19, further comprising one or more bearings disposed between:

one or more conversion elements selected from the group of conversion elements consisting of the first transverse conversion element, the second transverse conversion element, the first longitudinal conversion element, and the second longitudinal conversion element; or the at least one horizontal frame element connected thereto, the one or more bearings being configured to allow movement of the one or more conversion elements along at least the portion of the transverse width in response to a transverse force applied to the one or more conversion elements adjacent to the at least one horizontal frame element and to prevent movement of the one or more conversion elements along at least the portion of the transverse width in response to a force applied to the one or more conversion elements distal to the at least one horizontal frame element.

21. A system for converting sheet material into one or more packaging templates for assembly into one or more custom boxes or packaging material configured to receive at least one item to be packaged, the system comprising:

a converting machine comprising:

means for performing one or more longitudinal conversion functions on the sheet material; and means for performing one or more transverse conversion functions on the sheet material, wherein the means for performing one or more longitudinal conversion functions is selectively positionable about the at least one item.

22. The system of claim 21, wherein the means for performing one or more longitudinal conversion functions is slideably mounted on a track to facilitate selective repositioning thereof.

23. The system of claim 21, wherein the means for performing one or more transverse conversion functions is slideably mounted on a track to facilitate selective repositioning thereof.

24. The system of claim 21, wherein the converting machine is configured to produce the one or more packaging templates in accordance with one or more outer dimensions of the at least one item.

25. The system of claim 24, wherein means for performing one or more longitudinal conversion functions and the means for performing one or more transverse conversion functions conform to the one or more outer dimensions.

26. The system of claim 21, wherein the converting machine further comprises:

a first side, a second side, and a transverse width therebetween; and a first end, a second end, and a longitudinal length therebetween;

an item receiving area having a base member configured to receive the at least one item, the at least one item having a plurality of outer dimensions including a height, a length, and a width disposed between a first outer side wall and an opposing second outer side wall; and a converting assembly aligned with the receiving area, the converting assembly comprising the means for performing one or more longitudinal conversion functions and the means for performing one or more transverse conversion functions, wherein the means for performing one or more longitudinal conversion functions comprises first and second longitudinal conversion elements moveably mounted to a transverse frame element such that the first and second longitudinal conversion elements are selectively positionable along at least a portion of the transverse width, and wherein the means for performing one or more transverse conversion functions comprises first and second transverse conversation elements moveably mounted to a transverse frame element such that the first and second transverse conversion elements are selectively moveable along at least a portion of the transverse width.

27. The system of claim 26, wherein the plurality of outer dimensions provide parameters for selectively positioning the first and second longitudinal conversion elements and for selectively moving the first and second transverse conversation elements.

28. The system of claim 26, wherein the first and second longitudinal conversion elements are adapted to be selectively positioned respectively adjacent to first and second outer side walls of the one or more to-be-packaged items.

29. The system of claim 26, further comprising a longitudinal advancing mechanism configured to advance the sheet material through the converting assembly along the longitudinal length such that the sheet material is advanced past the first and second longitudinal conversion elements.

30. The system of claim 26, wherein the first and second longitudinal conversion elements each comprise one or more converting instruments configured to perform one or more longitudinal conversion functions at different positions along a transverse width of the sheet material, the one or more longitudinal conversion functions being selected from the group consisting of creasing, bending, folding, perforating, cutting, and scoring.

31. The system of claim 30, wherein the one or more converting instruments of the first and second longitudinal conversion elements comprise one or more cutting wheels.

32. The system of claim 30, wherein the one or more converting instruments of the first and second longitudinal conversion elements comprise one or more creasing wheels.

33. The system of claim 26, wherein the first and second transverse conversion elements each comprise one or more converting instruments configured to perform one or more transverse conversion functions at different positions along a longitudinal length of the sheet material, the one or more transverse conversion functions being selected from the group consisting of creasing, bending, folding, perforating, cutting, and scoring.

34. The system of claim 33, wherein the one or more converting instruments of the first and second transverse conversion elements comprise one or more cutting wheels.

35. The system of claim 33, wherein the one or more converting instruments of the first and second transverse conversion elements comprise one or more creasing wheels.

36. The system of claim 21, wherein the converting machine is positioned adjacent to a feed supply of sheet material.

37. The system of claim 21, wherein the feed supply of sheet material is selected from the group consisting of paperboard, corrugated board, and cardboard.

38. The system of claim 21, further comprising a frame that elevates the converting machine above a support surface, the frame comprising a base and generally upright supports.

39. The system of claim 21, wherein the converting machine is positioned on top of a table.

40. The system of claim 21, further comprising a feed supply of sheet material configured to be fed into the converting machine.

* * * * *